US011458730B2

(12) United States Patent
Takabe et al.

(10) Patent No.: US 11,458,730 B2
(45) Date of Patent: Oct. 4, 2022

(54) LIQUID EJECTING HEAD, ACTUATOR, LIQUID EJECTING APPARATUS, AND METHOD FOR MANUFACTURING LIQUID EJECTING HEAD

(71) Applicant: SEIKO EPSON CORPORATION, Tokyo (JP)

(72) Inventors: Motoki Takabe, Shiojiri (JP); Masanori Mikoshiba, Shimosuwa-machi (JP); Masaki Mori, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 33 days.

(21) Appl. No.: 17/188,336

(22) Filed: Mar. 1, 2021

(65) Prior Publication Data

US 2021/0268798 A1 Sep. 2, 2021

(30) Foreign Application Priority Data

Mar. 2, 2020 (JP) ..... JP2020-034756

(51) Int. Cl.
*B41J 2/14* (2006.01)
*B41J 2/16* (2006.01)

(52) U.S. Cl.
CPC ..... *B41J 2/14233* (2013.01); *B41J 2/161* (2013.01); *B41J 2002/14258* (2013.01)

(58) Field of Classification Search
CPC ..... B41J 2/14233; B41J 2/161; B41J 2002/14258; B41J 2/1623; B41J 2/1628; B41J 2/1629; B41J 2/1632; B41J 2/1642; B41J 2/1645; B41J 2002/14491; B41J 2/1646
See application file for complete search history.

(56) References Cited

U.S. PATENT DOCUMENTS

| | | | |
|---|---|---|---|
| 2013/0135400 | A1 | 5/2013 | Yazaki et al. |
| 2014/0043401 | A1 | 2/2014 | Torimoto et al. |
| 2015/0231883 | A1 | 8/2015 | Hirai et al. |
| 2016/0067967 | A1 | 3/2016 | Naganuma et al. |

(Continued)

FOREIGN PATENT DOCUMENTS

| | | | |
|---|---|---|---|
| JP | 2015-171809 | A | 10/2015 |
| JP | 2016-058467 | A | 4/2016 |
| JP | 2016-135611 | A | 7/2016 |

(Continued)

OTHER PUBLICATIONS

IP.com search (Year: 2022).*

*Primary Examiner* — Lisa Solomon
(74) *Attorney, Agent, or Firm* — Workman Nydegger

(57) ABSTRACT

A liquid ejecting head includes a diaphragm, a first electrode, a piezoelectric layer, and a second electrode in this order in a first direction, and ejects liquid. The second electrode includes a first portion that is next to the piezoelectric layer in the first direction and is electrically conductive. A length in the first direction is defined as a thickness. One position in a second direction intersecting with the first direction is defined as a first position. Another one position is defined as a second position that is closer to an end of the second electrode in the second direction than the first position is. Given the definition, the thickness of the first portion at the second position is less than the thickness of the first portion at the first position.

22 Claims, 14 Drawing Sheets

(56) References Cited

U.S. PATENT DOCUMENTS

| | | | |
|---|---|---|---|
| 2016/0221340 | A1 | 8/2016 | Hirai et al. |
| 2018/0277737 | A1* | 9/2018 | Ohashi ..... H01L 41/0973 |

FOREIGN PATENT DOCUMENTS

| | | | |
|---|---|---|---|
| JP | 2016-137679 | A | 8/2016 |
| JP | 2017-074798 | A | 4/2017 |
| JP | 2017-152554 | A | 8/2017 |

* cited by examiner

LIQUID EJECTING HEAD, ACTUATOR, LIQUID EJECTING APPARATUS, AND METHOD FOR MANUFACTURING LIQUID EJECTING HEAD

The present application is based on, and claims priority from JP Application Serial Number 2020-034756, filed Mar. 2, 2020, the disclosure of which is hereby incorporated by reference herein in its entirety.

BACKGROUND

1. Technical Field

Embodiments of the present disclosure relate to a liquid ejecting head, an actuator, a liquid ejecting apparatus, and a method for manufacturing a liquid ejecting head.

2. Related Art

In a piezoelectric-type liquid ejecting head of related art, a lower electrode, a piezoelectric layer, and an upper electrode are formed in layers in this order over a diaphragm. In order to prevent the development of a crack, etc. in a piezoelectric layer, a liquid ejecting head disclosed in JP-A-2016-58467 includes an upper electrode layer extending to an area for inhibiting the flexural deformation of the piezoelectric layer, a common metal layer extending to a position overlapping with this area, and a common adhesion layer extending to an end of the upper electrode layer beyond a position overlapping with the common metal layer. The thickness of the upper electrode layer is constant.

In the area for inhibiting the flexural deformation of the piezoelectric layer, an overlapping portion that overlaps with the upper electrode layer becomes distorted when a voltage is applied to the piezoelectric layer, whereas a non-overlapping portion that does not overlap with the upper electrode layer does not become distorted. In particular, the frequency of the distortional operation of the overlapping portion is high when the frequency of a drive pulse supplied from electrodes to the piezoelectric layer is high. For this reason, in the liquid ejecting head described above, the boundary between the overlapping portion and the non-overlapping portion in the piezoelectric layer is prone to cracking, etc.

The problem explained above occurs not only in liquid ejecting heads but also in various actuators and liquid ejecting apparatuses, etc. equipped with a piezoelectric layer.

SUMMARY

A liquid ejecting head according to a certain aspect of the present disclosure is a liquid ejecting head that ejects liquid, comprising: a diaphragm; a first electrode; a piezoelectric layer; and a second electrode, wherein the diaphragm, the first electrode, the piezoelectric layer, and the second electrode are comprised in this order in a first direction, the second electrode includes a first portion that is next to the piezoelectric layer in the first direction and is electrically conductive, a length in the first direction is defined as a thickness, one position in a second direction intersecting with the first direction is defined as a first position, another one position is defined as a second position that is closer to an end of the second electrode in the second direction than the first position is, and when above definition is given, the thickness of the first portion at the second position is less than the thickness of the first portion at the first position.

A liquid ejecting apparatus according to a certain aspect of the present disclosure includes the liquid ejecting head described above and a control unit that controls operation of ejecting the liquid from the liquid ejecting head described above.

An actuator according to a certain aspect of the present disclosure includes: a diaphragm; a first electrode; a piezoelectric layer; and a second electrode, wherein the diaphragm, the first electrode, the piezoelectric layer, and the second electrode are comprised in this order in a first direction, the second electrode includes a first portion that is next to the piezoelectric layer in the first direction and is electrically conductive, a length in the first direction is defined as a thickness, one position in a second direction intersecting with the first direction is defined as a first position, another one position is defined as a second position that is closer to an end of the second electrode in the second direction than the first position is, and when above definition is given, the thickness of the first portion at the second position is less than the thickness of the first portion at the first position.

A method for manufacturing a liquid ejecting head according to a certain aspect of the present disclosure is a method for manufacturing a liquid ejecting head that includes a diaphragm, a first electrode, a piezoelectric layer, and a second electrode in this order in a first direction, wherein the second electrode includes a first portion that is next to the piezoelectric layer in the first direction and is electrically conductive, a plurality of positions in a second direction intersecting with the first direction includes a first position and a second position, the second position being closer to an end of the second electrode than the first position is, and the first portion includes a first conductive portion and a second conductive portion, the method comprising: a layering step of forming the first electrode and the piezoelectric layer in layers in this order over the diaphragm; a first conductive portion forming step of forming the first conductive portion that is next to the piezoelectric layer in the first direction; and a second conductive portion forming step of forming, at the first position, the second conductive portion that is next to the first conductive portion in the first direction, and not forming the second conductive portion at the second position.

DESCRIPTION OF EXEMPLARY EMBODIMENTS

Embodiments of the present disclosure will now be described. Of course, the embodiments are described below just for showing some examples of the present disclosure, and not all of the features described in the embodiments are necessarily indispensable to the solution provided by the present disclosure.

1. OVERVIEW OF THE TECHNIQUE INCLUDED IN THE PRESENT DISCLOSURE

First, an overview of the technique included in the present disclosure is presented below. FIGS. 1 to 20 schematically illustrate some examples of the present disclosure. The directions in these drawings may be shown on scales different from each other. These drawings are not necessarily consistent with each other. Of course, elements of the disclosed technique are not limited to specific examples denoted by reference signs. In "Overview of the technique included in the present disclosure", each parenthesized description is a supplementary explanation of the word(s), etc. immediately preceding the parentheses.

In the present application, a numerical range "Min to Max" means a range of values equal to or greater than the minimum value Min and equal to or less than the maximum value Max. Compositional ratios expressed by chemical formulae represent stoichiometric proportion, and substances expressed by the chemical formulae include those deviating from the stoichiometric proportion.

Figure 5:
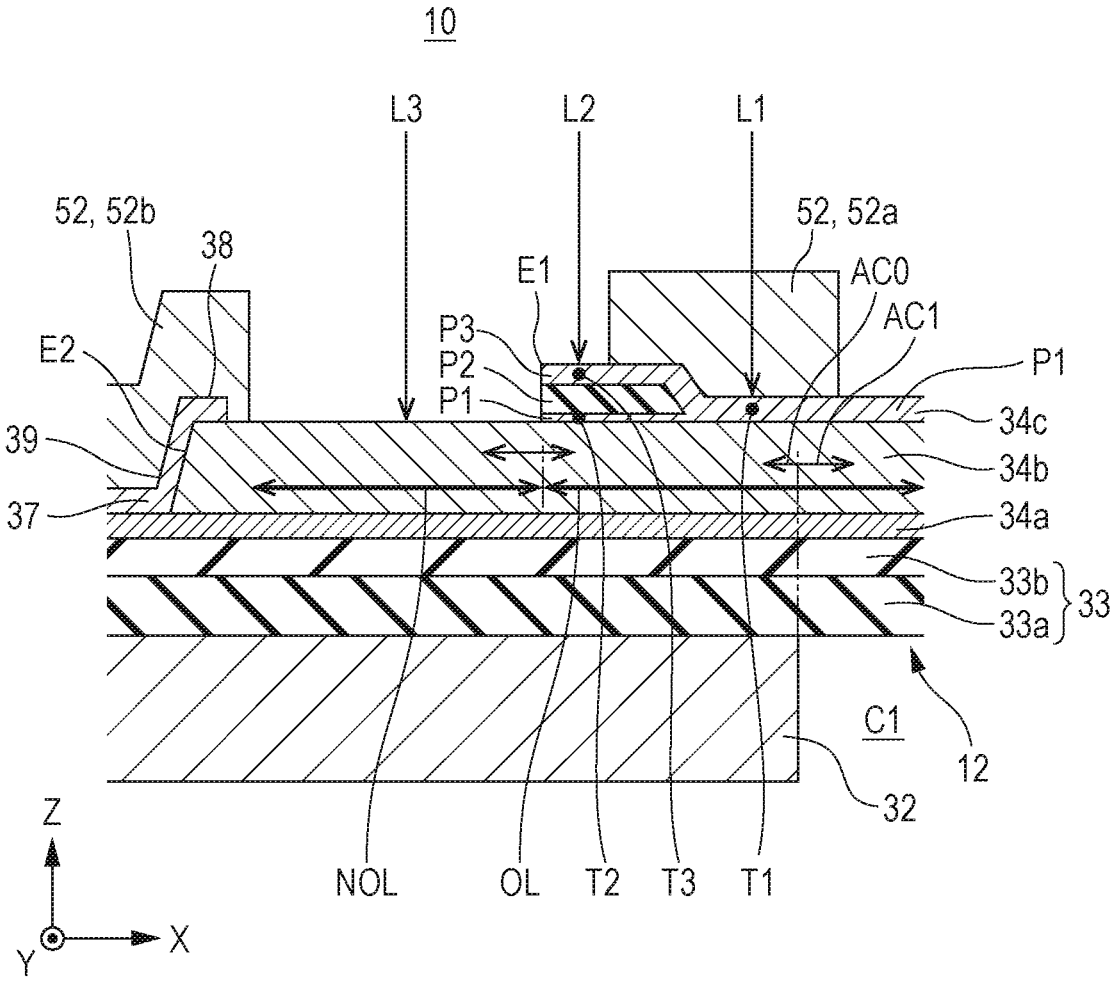
FIG. 5 is a sectional view that schematically illustrates an example of the structure of an essential part of the liquid ejecting head, taken at a position along the line V-V of FIG. 2.

As illustrated in FIG. 5, etc., a liquid ejecting head 10 according to a certain embodiment of the disclosed technique includes a diaphragm 33, a first electrode 34*a*, a piezoelectric layer 34*b*, and a second electrode 34*c* in this order in a first direction (for example, +Z direction), and ejects liquid LQ. The second electrode 34*c* includes a first portion P1 that is electrically conductive. The first portion P1 is next to the piezoelectric layer 34*b* in the first direction (+Z direction). A length in the first direction (+Z direction) is defined herein as a thickness. One position in a second direction (for example, X-axis direction) intersecting with the first direction (+Z direction) is defined herein as a first position L1. Another one position is defined herein as a second position L2, wherein the second position L2 is closer to an end E1 of the second electrode 34*c* in the second direction (X-axis direction) than the first position L1 is. The thickness of the first portion P1 at the second position L2, denoted as t2, is less than the thickness of the first portion P1 at the first position L1, denoted as t1.

For example, the first portion P1 may include a first thickness portion T1, which is located at the first position L1 in the second direction (X-axis direction) intersecting with the first direction (+Z direction), and a second thickness portion T2, which is located at the second position L2 that is closer to the end E1 of the second electrode 34*c* in the second direction (X-axis direction) than the first position L1 is. In this instance, the second thickness portion T2 is thinner than the first thickness portion T1.

In the description below, a portion where the piezoelectric layer 34*b* and the second electrode 34*c* overlap with each other along the X-axis direction (the piezoelectric layer 34*b* and the second electrode 34*c* overlap with each other when viewed in the −Z direction) is referred to as the overlapping portion OL of the piezoelectric layer 34*b*. A portion where the piezoelectric layer 34*b* and the second electrode 34*c* do not overlap with each other along the X-axis direction (the piezoelectric layer 34*b* and the second electrode 34*c* do not overlap with each other when viewed in the −Z direction) is referred to as the non-overlapping portion NOL of the piezoelectric layer 34*b*. A voltage with a varying drive pulse is applied to the overlapping portion OL. Almost no voltage is applied to the non-overlapping portion NOL. If the thickness of the second electrode 34*c* is constant, the voltage applied to the piezoelectric layer 34*b* changes sharply at the boundary between the overlapping portion OL and the non-overlapping portion NOL. Such a sharp change in the voltage at the boundary is inferred to cause cracking, etc. in the piezoelectric layer 34*b*.

In the above embodiment of the disclosed technique, in which the second electrode 34*c* includes the first portion P1 that is electrically conductive, the thickness t2 of the first portion P1 at the second position L2 that is relatively near the end E1 of the second electrode 34*c* in the second direction (X-axis direction) intersecting with the first direction (+Z direction) (for example, the thickness of the second thickness portion T2) is less than the thickness t1 of the first portion P1 at the first position L1 that is relatively distant from the end E1 of the second electrode 34*c* in the second direction (X-axis direction) (for example, the thickness of the first thickness portion T1). Because of this structure, the electric resistance of the first portion P1 at the second position L2 (for example, the second thickness portion T2) is higher than that at the first position L1 (for example, the first thickness portion T1). Since the voltage level of a drive pulse changes, the voltage applied to the piezoelectric layer 34*b* is akin to an alternating-current voltage. Charging and discharging of electric charges are inhibited to some extent at the second position L2, at which the electric resistance is higher (for example, the second thickness portion T2), in the first portion P1. Therefore, in the piezoelectric layer 34*b*, the applied voltage in the neighborhood of the boundary between the overlapping portion OL and the non-overlapping portion NOL changes gently. For this reason, the above embodiment makes it possible to provide a liquid ejecting head that prevents a problem such as the development of a crack from occurring at the boundary between the overlapping portion and the non-overlapping portion in the piezoelectric layer 34*b*.

The second electrode 34*c* may further include a second portion P2 that is next to the first portion P1 in the first direction (+Z direction) and is less conductive than the first portion P1. The second portion P2, which is less conductive, serves as a structure component that prevents a crack, etc. from being developed in the piezoelectric layer 34*b*. Since the second electrode 34*c* includes the second portion P2, it is possible to more effectively prevent a problem such as the development of a crack from occurring at the boundary between the overlapping portion and the non-overlapping portion in the piezoelectric layer 34*b*. If the second portion P2 has a compressive stress, the second portion P2 is able to fulfill its function as a crack-preventing structure more effectively. The second electrode 34*c* may further include a third portion P3 that is next to the second portion P2 in the first direction (+Z direction) and is more conductive than the second portion P2.

Figure 7:
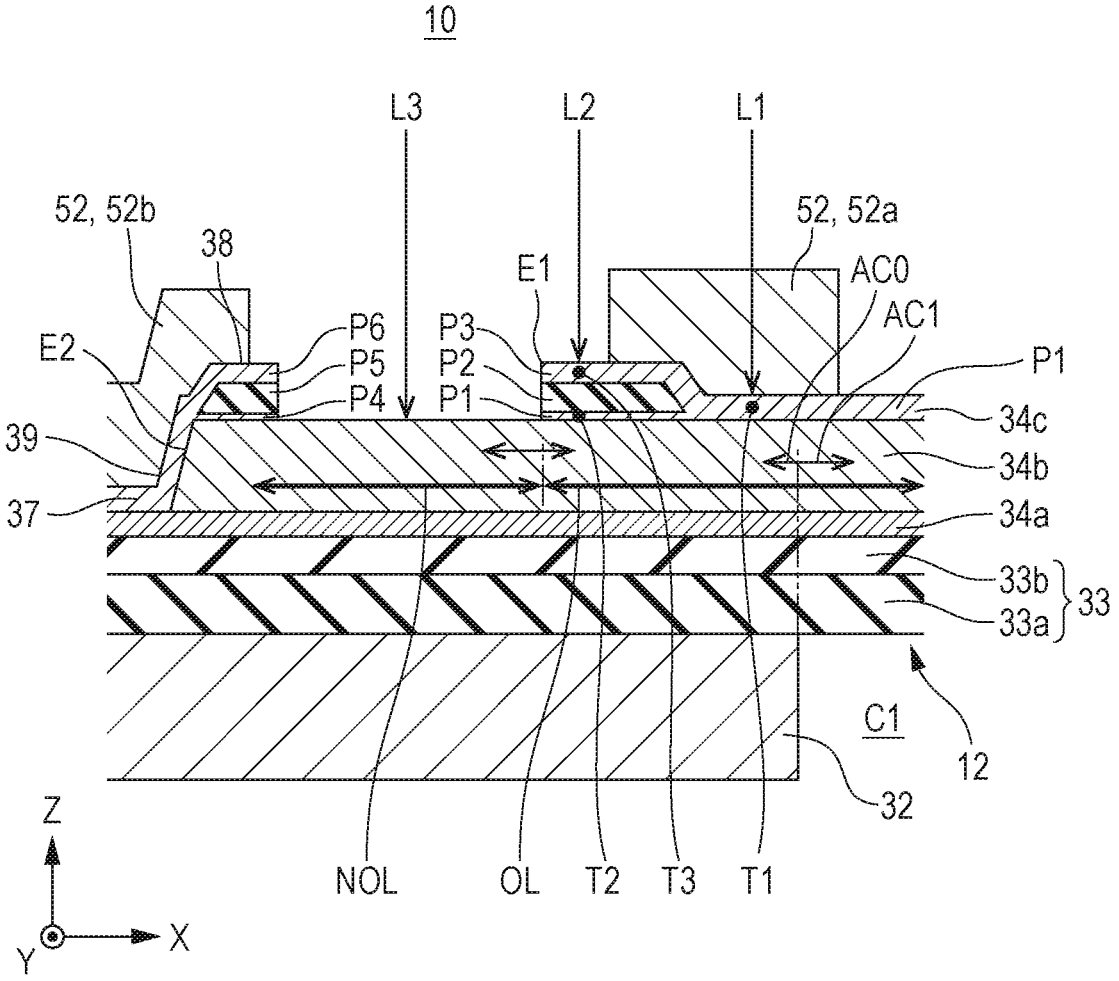
FIG. 7 is a sectional view that schematically illustrates an example of the structure of an essential part of the liquid ejecting head, taken at a position along the line VII-VII of FIG. 2, wherein a third electrode includes a fifth portion that is less conductive.

As illustrated in FIG. 7, etc., the liquid ejecting head 10 according to the present embodiment may further include a third electrode 37 that includes a continuing portion 38 that is next to the piezoelectric layer 34*b* in the first direction (+Z direction). The continuing portion 38 may include a fourth portion P4 that is next to the piezoelectric layer 34*b* in the first direction (+Z direction) and is electrically conductive. The continuing portion 38 may further include a fifth portion P5 that is next to the fourth portion P4 in the first direction (+Z direction) and is less conductive than the fourth portion P4. This structure decreases electric field intensity between the second electrode 34*c* and the third electrode 37 and thus prevents migration, a phenomenon of an electric current flow between the second electrode 34*c* and the third electrode 37, from occurring. The continuing portion 38 may further include a sixth portion P6 that is next to the fifth portion P5 in the first direction (+Z direction) and is more conductive than the fifth portion P5.

Figure 1:
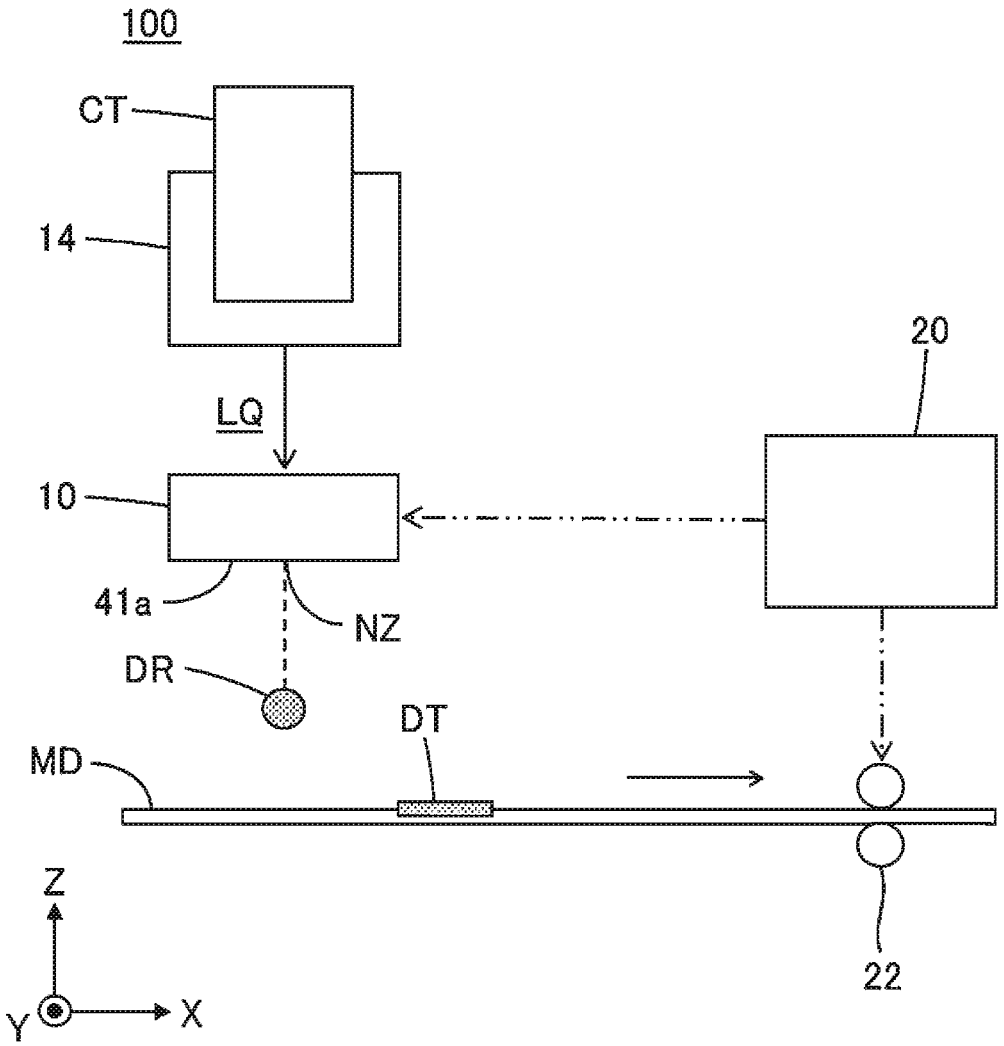
FIG. 1 is a diagram that schematically illustrates an example of the structure of a liquid ejecting apparatus.

As illustrated in FIG. 1, a liquid ejecting apparatus 100 according to a certain embodiment of the disclosed technique includes the liquid ejecting head 10 explained above and a control unit 20 that controls the operation of ejecting the liquid LQ from the liquid ejecting head 10 explained above. This embodiment makes it possible to provide a liquid ejecting apparatus that prevents a problem such as the development of a crack from occurring at the boundary between the overlapping portion and the non-overlapping portion in the piezoelectric layer.

An actuator 12 according to a certain embodiment of the disclosed technique includes the diaphragm 33, the first electrode 34*a*, the piezoelectric layer 34*b*, and the second electrode 34*c* in this order in the first direction (+Z direction). The second electrode 34*c* includes the first portion P1 that is next to the piezoelectric layer 34*b* in the first direction (+Z direction) and is electrically conductive. The thickness of the first portion P1 at the second position L2, denoted as t2, is less than the thickness of the first portion P1 at the first position L1, denoted as t1.

In the above embodiment of the disclosed technique, in which the second electrode 34*c* includes the first portion P1 that is electrically conductive, the thickness t2 of the first portion P1 at the second position L2 that is relatively near the end E1 of the second electrode 34*c* in the second direction (X-axis direction) intersecting with the first direction (+Z direction) (for example, the thickness of the second thickness portion T2) is less than the thickness t1 of the first portion P1 at the first position L1 that is relatively distant from the end E1 of the second electrode 34*c* in the second direction (X-axis direction) (for example, the thickness of the first thickness portion T1). Because of this structure, the electric resistance of the first portion P1 at the second position L2 (for example, the second thickness portion T2) is higher than that at the first position L1 (for example, the first thickness portion T1). Therefore, in the piezoelectric layer 34*b*, the applied voltage in the neighborhood of the boundary between the overlapping portion OL and the non-overlapping portion NOL changes gently. Therefore, the above embodiment makes it possible to provide an actuator that prevents a problem such as the development of a crack from occurring at the boundary between the overlapping portion and the non-overlapping portion in the piezoelectric layer.

As illustrated in FIGS. 9 to 20, a method for manufacturing a liquid ejecting head 10 according to a certain embodiment of the disclosed technique is a method for manufacturing the liquid ejecting head 10 that includes the diaphragm 33, the first electrode 34*a*, the piezoelectric layer 34*b*, and the second electrode 34*c* in this order in the first direction (+Z direction). The second electrode 34*c* includes the first portion P1 that is next to the piezoelectric layer 34*b* in the first direction (+Z direction) and is electrically conductive. A plurality of positions in the second direction (X-axis direction) intersecting with the first direction (+Z direction) includes the first position L1 and the second position L2. The second position L2 is closer to the end E1 of the second electrode 34*c* than the first position L1 is. The first portion P1 includes a first conductive portion CD1 and a second conductive portion CD2. The manufacturing method includes a layering step of forming the first electrode 34*a* and the piezoelectric layer 34*b* in layers in this order over the diaphragm 33, a first conductive portion forming step of forming the first conductive portion CD1 that is next to the piezoelectric layer 34*b* in the first direction (+Z direction), and a second conductive portion forming step of forming, at the first position L1, the second conductive portion CD2 that is next to the first conductive portion CD1 in the first direction (+Z direction), and not forming the second conductive portion CD2 at the second position L2.

In the above embodiment of the disclosed technique, in which the second electrode 34*c* includes the first portion P1 that is electrically conductive, the second conductive portion CD2 does not exist at the second position L2 that is relatively near the end E1 of the second electrode 34*c* in the second direction (X-axis direction) intersecting with the first direction (+Z direction), and the thickness of the first portion P1 at the second position L2 is less than the thickness of the first portion P1 at the first position L1 that is relatively distant from the end E1 of the second electrode 34*c* in the second direction (X-axis direction). Because of this structure, the electric resistance of the portion of the second electrode 34*c* at the second position L2 is higher than that at the first position L1. Therefore, in the piezoelectric layer 34*b*, the applied voltage in the neighborhood of the boundary between the overlapping portion OL and the non-overlapping portion NOL changes gently. Therefore, the above embodiment makes it possible to provide a method for manufacturing a liquid ejecting head that prevents a problem such as the development of a crack from occurring at the boundary between the overlapping portion and the non-overlapping portion in the piezoelectric layer.

The meaning of "comprising: a diaphragm, a first electrode, a piezoelectric layer, and a second electrode in this order in a first direction" encompasses, but is not limited to, a case where there is a portion where the first electrode does not overlap with the diaphragm, a case where there is a portion where the piezoelectric layer does not overlap with the first electrode, and a case where there is a portion where the second electrode does not overlap with the piezoelectric layer.

The ordinal numbers such as "first", "second", and "third" used in the present application are terms for identifying and distinguishing, from one another, a plurality of components that have similarities. As such, these ordinal numbers are not intended to mean a sequential order.

2. SPECIFIC EXAMPLES OF THE LIQUID EJECTING APPARATUS

FIG. 1 schematically illustrates an example of the structure of the liquid ejecting apparatus 100, which includes the liquid ejecting head 10. To facilitate an explanation of positional relationships, an X axis, a Y axis, and a Z axis are shown in FIG. 1 and the other drawings. The X axis and the Y axis are orthogonal to each other. The Y axis and the Z axis are orthogonal to each other. The Z axis and the X axis are orthogonal to each other. The direction indicated by an arrow along the X axis is defined herein as a +X direction. The direction that is the opposite of the +X direction is defined herein as a −X direction. The direction indicated by an arrow along the Y axis is defined herein as a +Y direction. The direction that is the opposite of the +Y direction is defined herein as a −Y direction. The direction indicated by an arrow along the Z axis is defined herein as a +Z direction. The direction that is the opposite of the +Z direction is defined herein as a −Z direction. The +X direction and the −X direction are collectively referred to as an X-axis direction. The +Y direction and the −Y direction are collectively referred to as a Y-axis direction. The +Z direction and the −Z direction are collectively referred to as a Z-axis direction.

The liquid ejecting apparatus 100 illustrated in FIG. 1 includes a supply unit 14 for supplying the liquid LQ, the liquid ejecting head 10, a transportation unit 22 for transporting a medium MD, and the control unit 20.

Liquid containers CT, in which the liquid LQ is contained, are mounted on the supply unit 14. A hard container made of a synthetic resin, a bag-type soft pack made of a flexible film, a liquid tank that can be replenished with the liquid LQ, or the like can be used as the liquid container CT. If the liquid LQ is ink, the hard container is called as an ink cartridge, and the soft pack is called as an ink pack. The supply unit 14 supplies the liquid LQ to the liquid ejecting head 10.

In accordance with control by the control unit 20, the liquid ejecting head 10 ejects the liquid LQ in the form of droplets DR from nozzles NZ. The liquid droplets DR are designed to be ejected in the −Z direction. If the medium MD is a print target, onto which printing is performed, the medium MD is a material that holds a plurality of dots DT formed by a plurality of liquid droplets DR. Paper, a synthetic resin, a cloth, metal, or the like can be used as the medium MD. The shape of the medium MD is not specifically limited. Examples of the shape of the medium MD are: a rectangular shape, a roll shape, a substantially circular shape, a polygonal shape other than a rectangle, a three-dimensional shape, etc. The liquid ejecting apparatus 100 is called as an ink-jet printer if configured to form a print image on the medium MD by ejecting ink droplets as the liquid droplets DR.

The term "liquid LQ" as used herein encompasses, but is not limited to, various kinds of liquid widely, for example, ink, a synthetic resin such as a photo-curable resin, an etchant, a living organism, and a lubricant. The term "ink" as used herein encompasses, but is not limited to, a wide variety of ink, for example, a solution in which dye is dissolved in a solvent, and a sol in which solid particles such as pigment or metal particles are dispersed in a dispersion medium.

In accordance with control by the control unit 20, the transportation unit 22 transports the medium MD in the +X direction. If the liquid ejecting apparatus 100 is a line printer, the plural nozzles NZ of the liquid ejecting head 10 are arranged throughout the entire width of the medium MD in the Y-axis direction. The liquid ejecting apparatus 100 may be equipped with a reciprocation drive unit that causes the liquid ejecting head 10 to move in the +Y direction and the −Y direction, as in a serial printer.

A circuit that includes, for example, a CPU or an FPGA, a ROM, a RAM, and the like may be used as the control unit 20. CPU is an acronym for Central Processing Unit. FPGA is an acronym for Field Programmable Gate Array. ROM is an acronym for Read Only Memory. RAM is an acronym for Random Access Memory. A circuit that includes "System on a Chip", which is abbreviated as SoC, may be used as the control unit 20. By controlling each component included in the liquid ejecting apparatus 100, the control unit 20 controls the operation of ejecting the liquid droplets DR from the liquid ejecting head 10.

If the liquid ejecting apparatus 100 is an ink-jet printer, a plurality of dots DT is formed on the medium MD when a plurality of liquid droplets DR ejected from the liquid ejecting head 10 lands onto the surface of the medium MD, which is transported by the transportation unit 22, A print image is formed on the medium MD as a result of this operation.

3. SPECIFIC EXAMPLES OF THE LIQUID EJECTING HEAD

Figure 2:
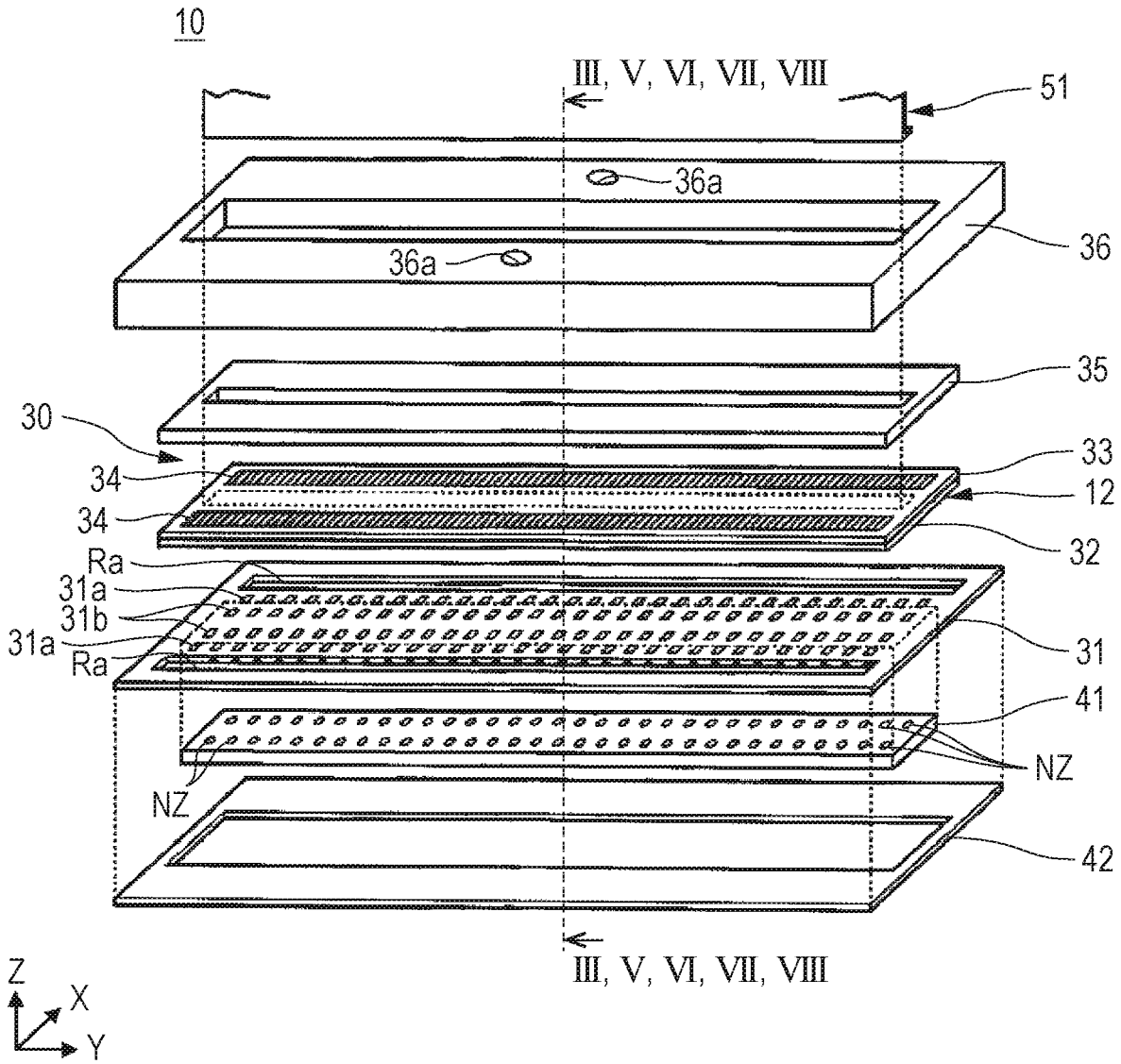
FIG. 2 is an exploded perspective view that schematically illustrates an example of the structure of a liquid ejecting head.
Figure 3:
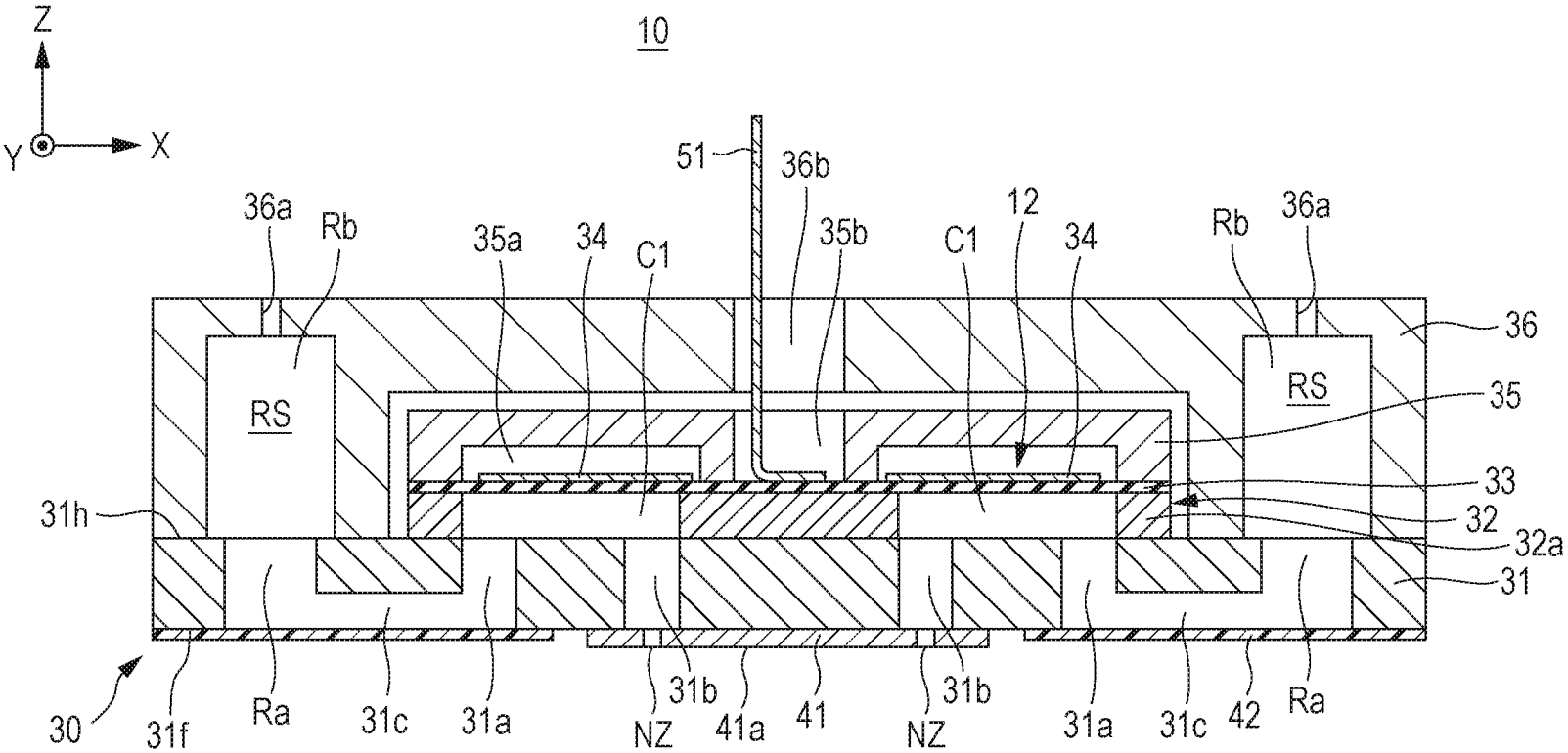
FIG. 3 is a sectional view that schematically illustrates an example of the structure of the liquid ejecting head, taken at a position along the line III-III of FIG. 2.
Figure 4:
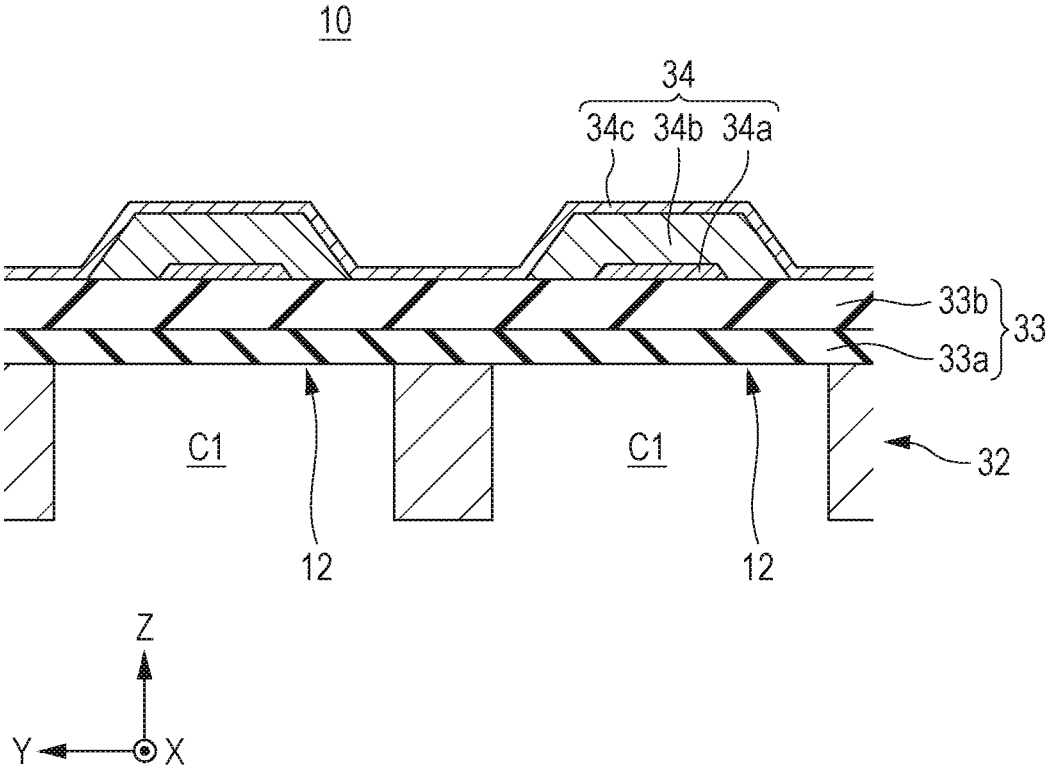
FIG. 4 is a sectional view that schematically illustrates an example of the structure of the liquid ejecting head.
Figure 6:
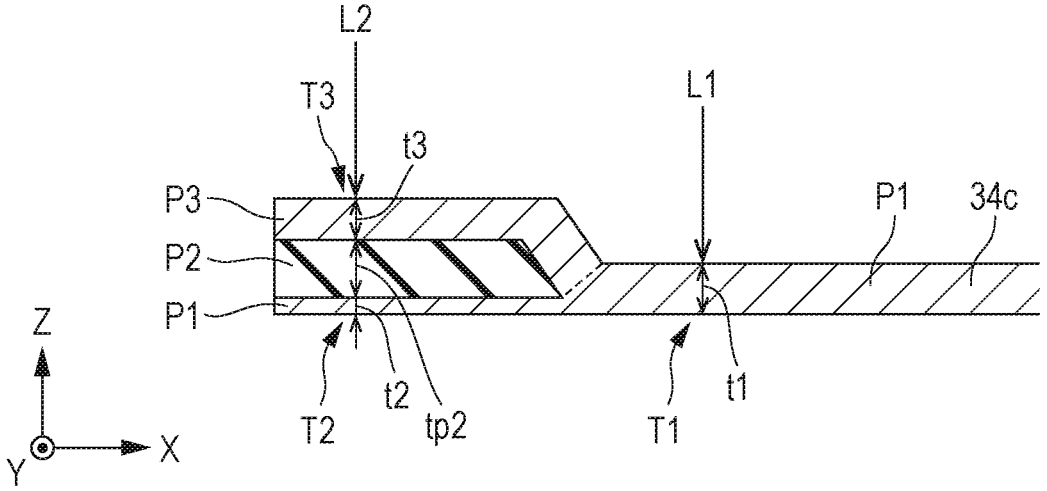
FIG. 6 is a sectional view that schematically illustrates an example of the structure of an essential part of a second electrode, taken at a position along the line VI-VI of FIG. 2.

FIG. 2 is an exploded perspective view that schematically illustrates an example of the structure of the liquid ejecting head 10. FIG. 3 is a sectional view that schematically illustrates an example of the structure of the liquid ejecting head 10, taken at a position along the line III-III of FIG. 2. FIG. 4 is a sectional view that schematically illustrates an example of the structure of an essential part of the liquid ejecting head 10 in a cross section orthogonal to the X axis. FIG. 5 is a sectional view that schematically illustrates an example of the structure of an essential part of the liquid ejecting head 10, taken at a position along the line V-V of FIG. 2. FIG. 6 is a sectional view that schematically illustrates an example of the structure of an essential part of the second electrode 34*c*, taken at a position along the line VI-VI of FIG. 2. In order to facilitate the understanding of the structure of the second electrode 34*c*, the hatching of the first portion P1 and the third portion P3 is omitted in FIG. 6. When it is stated herein that a first member and a second member are bonded to each other, the statement has a broad meaning that encompasses, but is not limited to, a case where the first member and the second member are bonded to each other in a state in which one or more layers such as one or more protective films are formed either on the first member or on the second member, or on both, and a case where the first member and the second member are bonded to each other by means of an adhesive applied therebetween.

The liquid ejecting head 10 illustrated in FIGS. 2 to 5 includes a nozzle substrate 41, a compliance substrate 42, a communication substrate 31, a pressure compartment substrate 32 on which the diagram 33 and piezoelectric elements 34, etc. are integrally provided, a protective substrate 35, a housing member 36, and a wiring substrate 51. The communication substrate 31, the pressure compartment substrate 32, the nozzle substrate 41, and the compliance substrate 42 are collectively referred to as a flow passage structure module 30. The flow passage structure module 30 is a structure module that has, inside itself, flow passages for supplying the liquid LQ to the nozzles NZ. Each member included in the flow passage structure module 30 is a rectangular plate-like member whose longer-side direction is along the Y axis. At a position passing through the protective substrate 35 in the X-axis direction, the liquid ejecting head 10 includes the nozzle substrate 41 and the compliance substrate 42, the communication substrate 31, the pressure compartment substrate 32, and the protective substrate 35 in this order in the +Z direction.

The nozzle substrate 41 is a plate-like member bonded to the −Z-directional end surface 31*f* of the communication substrate 31. The nozzle substrate 41 has the plurality of nozzles NZ from which the liquid LQ is ejected. The nozzle substrate 41 illustrated in FIG. 2 includes two nozzle rows, each of which is made up of a plurality of nozzles NZ arranged linearly in the Y-axis direction. Therefore, the Y-axis direction is a nozzle array direction. As illustrated in FIGS. 1 and 3, the surface from which the liquid droplets DR are ejected is referred to as the nozzle surface 41*a* of the nozzle substrate 41. Each of the plurality of nozzles NZ is a circular through-hole orifice that is in communication with the corresponding one of a plurality of communication holes 31*b* of the communication substrate 31 and goes through the nozzle substrate 41 in the Z-axis direction, which is the thickness direction of the nozzle substrate 41. In the nozzle surface 41*a*, there is a plurality of openings configured as the nozzles NZ. Therefore, the nozzle NZ is called also as a nozzle opening. The nozzle substrate 41 may be made of one or more kinds of material selected from the group including, for example, a silicon substrate, metal such as stainless steel, and the like. The nozzle substrate 41 is manufactured by, for example, processing a monocrystalline silicon substrate by using a semiconductor manufacturing technology such as photolithography and etching, etc. Of course, however, known materials and methods can be used for manufacturing the nozzle substrate 41.

A liquid-repellent coat that has liquid repellency may be provided on the nozzle surface 41*a*. The liquid-repellent coat is not specifically limited as long as it is repellent to liquid. For example, a metal film that includes a fluorine polymer, a molecular film of metalalkoxide that has liquid repellency, etc., may be used as the liquid-repellent coat.

The compliance substrate 42 is bonded to the surface 31*f* of the communication substrate 31 outside the nozzle substrate 41. The compliance substrate 42 illustrated in FIG. 3 seals a space Ra, which is included in a liquid reservoir RS common to a plurality of nozzles NZ, and a relay liquid chamber 31*c* common to the plurality of nozzles NZ. The compliance substrate 42 includes, for example, a sealing membrane that is flexible. For example, a flexible film that has a thickness of 20 μm or less can be used as the sealing membrane. Polyphenylenesulfide abbreviated as PPS, stainless steel, and the like can be used. The compliance substrate 42 constitutes the floor of the liquid reservoir RS and absorbs fluctuations in pressure of the liquid LQ inside the liquid reservoir RS.

The communication substrate 31 is provided over the nozzle substrate 41 and the compliance substrate 42 and under the pressure compartment substrate 32 and the housing member 36. The pressure compartment substrate 32 and the housing member 36 are bonded to the +Z-directional end surface 31*h* of the communication substrate 31. The communication substrate 31 has the space Ra common to the plurality of nozzles NZ, the relay liquid chamber 31*c* common to the plurality of nozzles NZ, supply holes 31*a* separated from one another individually to correspond to the nozzles NZ, and the communication holes 31*b* separated from one another individually to correspond to the nozzles NZ. The space Ra has a shape of an elongated cavity whose longer-side direction is along the Y axis. The relay liquid chamber 31*c* is an elongated space whose longer-side direction is along the Y axis. The space Ra, which is common to the plurality of nozzles NZ, is in communication with the plurality of supply holes 31*a* through the relay liquid chamber 31*c*. The communication substrate 31 illustrated in FIGS. 2 and 3 includes two supply-flow-passage rows, each of which is made up of a plurality of supply holes 31*a* arranged linearly in the Y-axis direction. Each of the plurality of supply holes 31*a* is a through hole that is in communication with the corresponding one of a plurality of pressure compartments Cl of the pressure compartment substrate 32 and goes through the communication substrate 31 in the Z-axis direction, which is the thickness direction of the communication substrate 31. That is, the communication substrate 31 includes the plurality of supply holes 31*a* through which the relay liquid chamber 31*c* is in communication with the plurality of pressure compartments Cl. The communication substrate 31 illustrated in FIGS. 2 and 3 further includes two communication-flow-passage rows, each of which is made up of the plurality of communication holes 31*b* arranged linearly in the Y-axis direction. Each of the plurality of communication holes 31*b* is a through hole that is in communication with the corresponding one of the plurality of pressure compartments Cl of the pressure compartment substrate 32 and with the corresponding one of the plurality of nozzles NZ of the nozzle substrate 41 and goes through the communication substrate 31 in the Z-axis direction, which is the thickness direction of the communication substrate 31. That is, the communication substrate 31 includes the plurality of communication holes 31*b* through which the plurality of pressure compartments Cl is in communication with the plurality of nozzles NZ respectively. Each of the plurality of communication holes 31*b* is located at a position in the +Z direction from the nozzle NZ.

The communication substrate 31 may be made of one or more kinds of material selected from the group including, for example, a silicon substrate, metal, ceramics, and the like. The communication substrate 31 is manufactured by, for example, processing a monocrystalline silicon substrate by using a semiconductor manufacturing technology such as photolithography and etching, etc. Of course, however, known materials and methods can be used for manufacturing the communication substrate 31.

The pressure compartment substrate 32 includes the plurality of pressure compartments Cl for applying, to the liquid LQ, pressure for ejecting the liquid LQ from the nozzles NZ. The pressure compartment substrate 32 includes the diaphragm 33 and the piezoelectric elements 34 on a surface that is the opposite of a surface facing the communication substrate 31. Of the pressure compartment substrate 32, the −Z-directional portion relative to the diaphragm 33 is hereinafter referred to as a pressure compartment substrate body portion 32*a*.

The pressure compartment substrate body portion 32*a* is bonded to the +Z-directional end surface 31*h* of the communication substrate 31. The pressure compartment substrate body portion 32*a* includes the plurality of pressure compartments Cl separated from one another individually to correspond to the nozzles NZ. Each of the plurality of pressure compartments Cl is located between the nozzle substrate 41 and the diaphragm 33 and is configured as a rectangular space whose longer-side direction is along the Y axis. The pressure compartment substrate body portion 32*a* includes two pressure-compartment rows, each of which is made up of a plurality of pressure compartments Cl arranged linearly in the Y-axis direction. Each of the plurality of pressure compartments Cl is in communication with the corresponding one of the plurality of supply holes 31*a* at its one end in the longer-side direction and is in communication with the corresponding one of the plurality of communication holes 31*b* at its opposite end in the longer-side direction.

The pressure compartment substrate body portion 32*a* may be made of one or more kinds of material selected from the group including, for example, a silicon substrate, metal, ceramics, and the like. The pressure compartment substrate body portion 32*a* is manufactured by, for example, processing a monocrystalline silicon substrate by using a semiconductor manufacturing technology such as photolithography and etching, etc. In this instance, if a silicon oxide layer is formed on the surface of a monocrystalline silicon substrate by thermal oxidation, etc., it is possible to use the silicon oxide layer as the diaphragm 33. Of course, however, known materials and methods can be used for manufacturing the pressure compartment substrate body portion 32*a*.

The diaphragm 33 integrated with the pressure compartment substrate body portion 32*a* has elasticity and constitutes a part of the wall surfaces of each compartment Cl. The diaphragm 33 may be made of one or more kinds of material selected from the group including, for example, silicon oxide symbolized as $SiO_x$, metal oxide, ceramics, a synthetic resin, and the like. The symbol $SiO_x$ according to its stoichiometric proportion represents silicon dioxide $SiO_2$; however, the subscript may be actually deviated from x=2. It is possible to form the diaphragm 33 by using, for example, thermal oxidation, a physical vapor growth method including sputtering, a vacuum deposition method including CVD, a liquid-phase method including spin coating, or the like. CVD is an acronym for Chemical Vapor Deposition.

The diaphragm 33 may include a plurality of layers, for example, an elastic layer 33*a* and an insulating layer 33*b*, as illustrated in FIG. 4. For example, the diaphragm 33 is formed by producing a layer of $SiO_x$ as the elastic layer 33*a* on the pressure compartment substrate body portion 32*a* and producing a layer of zirconium oxide symbolized as $ZrO_x$ as the insulating layer 33*b* on the elastic layer 33*a*. The thickness of the elastic layer 33*a* is not specifically limited. The thickness of the elastic layer 33*a* may be, for example, approximately 300 to 2,000 nm. The thickness of the insulating layer 33*b* is not specifically limited. The thickness of the insulating layer 33*b* may be, for example, approximately 30 to 600 nm.

Of course, the material of the diaphragm 33 is not limited to the above example. For example, the diaphragm 33 may be made of silicon nitride symbolized as $SiN_x$, titanium oxide symbolized as $TiO_x$, aluminum oxide symbolized as $AlO_x$, hafnium oxide symbolized as $HfO_x$, magnesium oxide symbolized as $MgO_x$, lanthanum aluminum oxide, or the like.

The piezoelectric elements 34, which are individually driven separately from one another to correspond to the pressure compartments Cl, are provided integrally on the +Z-directional end surface of the diaphragm 33. The piezoelectric element 34 and the diaphragm 33 are included in the actuator 12 that applies pressure to the pressure compartment Cl. The pressure compartment substrate 32 illustrated in FIGS. 2 and 3 includes two piezoelectric-element rows, each of which is made up of a plurality of piezoelectric elements 34 arranged linearly in the Y-axis direction. Each piezoelectric element 34 is a rectangular element whose longer-side direction is along the X axis. Each piezoelectric element 34 according to the specific example described here is a drive element that expands and contracts in accordance with a drive signal that includes drive-pulse repetitions having changes in voltage. For example, as illustrated in FIGS. 4 and 5, at a region of overlap with the first electrode 34*a*, the piezoelectric element includes the first electrode 34*a* formed like a layer, the piezoelectric layer 34*b* formed like a layer, and the second electrode 34*c* formed like a layer in this order in the +Z direction, and expands and contracts in accordance with a voltage applied between the first electrode 34*a* and the second electrode 34*c*. It is sufficient as long as at least one of the first electrode 34*a*, the piezoelectric layer 34*b*, and the second electrode 34*c* is separated for the plurality of piezoelectric elements 34. In other words, it is sufficient as long as not all of the first electrode 34*a*, the piezoelectric layer 34*b*, and the second electrode 34*c* are configured to be common to the plurality of piezoelectric elements 34. Therefore, the first electrode 34*a* may be configured as a common electrode that is continuous throughout, and is common to, the plurality of piezoelectric elements 34. The second electrode 34*c* may be configured as a common electrode that is continuous throughout, and is common to, the plurality of piezoelectric elements 34. The piezoelectric layer 34*b* may be continuous. In the specific example described here, it is assumed that the first electrode 34*a* is an individual electrode, the piezoelectric layer 34*b* is an individual piezoelectric layer, and the second electrode 34*c* is a common electrode. The second electrode 34*c* illustrated in FIGS. 5 and 6 includes the first portion P1 that is electrically conductive, the third portion P3 that is electrically conductive, and the second portion P2 that is less conductive than the first portion P1 and the third portion P3. The liquid ejecting head 10 illustrated in FIG. 5 further includes the third electrode 37, by which an end E2 of the piezoelectric layer 34*b* is covered.

The first electrode 34*a*, the first portion P1 of the second electrode 34*c*, the third portion P3 of the second electrode 34*c*, and the third electrode 37 may be made of a conductive material such as, for example, metal such as iridium or platinum, conductive metal oxide such as indium tin oxide symbolized as ITO, or the like. If an electrode is made of iridium, the principal component of the electrode is iridium. In this instance, the electrode may be substantially made of iridium except for impurities or may contain a secondary component whose content is less than the content of the principal component. The thickness of the first electrode 34*a* is not specifically limited. The thickness of the first electrode 34*a* may be, for example, approximately 50 to 300 nm.

For example, $TiO_x$, tantalum oxide symbolized as $TaO_x$, $AlO_x$, $ZrO_x$, $SiO_x$, or the like can be used as the material of the second portion P2 of the second electrode 34*c*.

If the second portion P2 is made of $TiO_x$, the principal component of the second portion P2 is $TiO_x$. In this instance, the second portion P2 may be substantially made of $TiO_x$ except for impurities or may contain a secondary component whose content is less than the content of the principal component. The symbol $TiO_x$ according to its stoichiometric proportion represents titanium dioxide $TiO_2$; however, the subscript may be actually deviated from x=2.

If the second portion P2 is made of $TaO_x$, the principal component of the second portion P2 is $TaO_x$. In this instance, the second portion P2 may be substantially made of $TaO_x$ except for impurities or may contain a secondary component whose content is less than the content of the principal component. The symbol $TaO_x$ according to its stoichiometric proportion represents tantalum pentoxide $Ta_2O_5$; however, the subscript value may be actually deviated from x=2.5.

If the second portion P2 is made of $AlO_x$, the principal component of the second portion P2 is $AlO_x$. In this instance, the second portion P2 may be substantially made of $AlO_x$ except for impurities or may contain a secondary component whose content is less than the content of the principal component. The symbol $AlO_x$ according to its stoichiometric proportion represents aluminum trioxide $Al_2O_3$; however, the subscript value may be actually deviated from x=1.5.

If the second portion P2 is made of $ZrO_x$, the principal component of the second portion P2 is $ZrO_x$. In this instance, the second portion P2 may be substantially made of $ZrO_x$ except for impurities or may contain a secondary component whose content is less than the content of the principal component. The symbol $ZrO_x$ according to its stoichiometric proportion represents zirconium dioxide $ZrO_2$; however, the subscript may be actually deviated from x=2.

If the second portion P2 is made of $SiO_x$, the principal component of the second portion P2 is $SiO_x$. In this instance, the second portion P2 may be substantially made of $SiO_x$ except for impurities or may contain a secondary component whose content is less than the content of the principal component. The symbol $SiO_x$ according to its stoichiometric proportion represents silicon dioxide $SiO_2$; however, the subscript may be actually deviated from x=2.

The piezoelectric layer 34*b* may be made of a material that has a perovskite structure, etc., for example, lead zirconate titanate symbolized as PZT, relaxor ferroelectrics obtained by adding metal such as niobium or nickel, etc. to PZT, lead-free perovskite-type oxide such as a $BiFeO_x$—$BaTiO_y$ piezoelectric material, etc. The thickness of the piezoelectric layer 34*b* is not specifically limited. The thickness of the piezoelectric layer 34*b* may be, for example, approximately 0.7 to 5 μm.

The protective substrate 35 includes a space 35*a* for protecting the plurality of piezoelectric elements 34. The protective substrate 35 further includes a through hole 35*b* through which the wiring substrate 51 is routed out. The protective substrate 35 is bonded to the +Z-directional end surface of the diaphragm 33. The protective substrate 35 bonded thereto enhances the mechanical strength of the pressure compartment substrate 32. The protective substrate 35 may be made of one or more kinds of material selected from the group including, for example, a silicon substrate, metal, ceramics, a synthetic resin, and the like. The protective substrate 35 is manufactured by, for example, processing a monocrystalline silicon substrate by using a semiconductor manufacturing technology such as photolithography and etching, etc. Of course, however, known materials and methods can be used for manufacturing the protective substrate 35.

The housing member 36 is bonded to the +Z-directional end surface 31*h* of the communication substrate 31 outside the pressure compartment substrate 32 and the protective substrate 35. The housing member 36 illustrated in FIG. 3 has a space Rb, which is included in the liquid reservoir RS common to the plurality of nozzles NZ, a supply inlet 36*a*, through which the space Rb is in communication with the outside, and a through hole 36*b* through which the wiring substrate 51 is routed out. The space Rb has a shape of an elongated cavity whose longer-side direction is along the Y axis. The +Z-directional end surface of the housing member 36 has openings, that is, supply inlets 36*a*. The liquid LQ is supplied from the liquid container CT to the supply inlet 36*a*. The housing member 36 may be made of one or more kinds of material selected from the group including, for example, a synthetic resin, metal, ceramics, and the like. For example, the housing member 36 is manufactured by injection molding of a synthetic resin. Of course, however, known materials and methods can be used for manufacturing the housing member 36.

The wiring substrate 51 is a flexible mount component that includes a drive circuit for driving the piezoelectric elements 34. The wiring substrate 51 is connected to the +Z-directional end surface of the diaphragm 33 between the piezoelectric-element rows. The connection portion of the wiring substrate 51 to the diaphragm 33 is connected to the first electrode 34*a* and the second electrode 34*c* via lead wires 52 illustrated in FIG. 5, for example. An FPC, an FFC, or a COF, etc. can be used as the wiring substrate 51. FPC is an acronym for Flexible Printed Circuit. FFC is an acronym for Flexible Flat Cable. COF is an acronym for Chip On Film. To each piezoelectric element 34, a drive signal for driving the piezoelectric element 34 and a reference voltage are supplied from the wiring substrate 51. One or more kinds of metal selected from the group including Au, Pt, Al, Cu, Ni, Cr, Ti, and the like can be used for forming the lead wire 52. The lead wire 52 may include an adhesion layer made of nichrome symbolized as NiCr.

As described above, the liquid LQ that flows out of the liquid container CT flows through the supply inlet 36*a*, the liquid reservoir RS, the relay liquid chamber 31*c*, the individual supply hole 31*a*, the individual pressure compartment Cl, the individual communication hole 31*b*, and the individual nozzle NZ in this order. When the piezoelectric element 34 is driven to cause the pressure compartment Cl to contract, the liquid droplet DR is ejected from the nozzle NZ in the −Z direction.

As illustrated in FIG. 5, the piezoelectric layer 34*b* provided in the +Z direction from the pressure compartment substrate 32 has a pressure compartment corresponding area AC1, which overlaps with the pressure compartment Cl, and a pressure compartment non-corresponding area AC0, which does not overlap with the pressure compartment Cl. A displacement in the Z-axis direction occurs at a portion located at the pressure compartment corresponding area AC1, of the piezoelectric layer 34*b*, in such a way as to cause flexural deformation of the diaphragm 33 when a voltage is applied between the first electrode 34*a* and the second electrode 34*c*. A displacement does not occur easily at a portion located at the pressure compartment non-corresponding area AC0, of the piezoelectric layer 34*b*, when a voltage is applied between the first electrode 34*a* and the second electrode 34*c* due to inhibition of flexural deformation of the piezoelectric layer 34*b* thereat. Therefore, at the part of the piezoelectric layer 34*b* located at the pressure compartment non-corresponding area AC0, the overlapping portion OL overlapping with the second electrode 34*c* becomes distorted when the voltage is applied to the piezoelectric layer 34*b*, whereas the non-overlapping portion NOL not overlapping with the second electrode 34*c* does not become distorted. In particular, the frequency of the distortional operation of the overlapping portion OL is high when the frequency of the drive pulse supplied from the electrodes 34*a* and 34*c* to the piezoelectric layer 34*b* is high. If the thickness of the second electrode 34*c* is constant, the distortion changes sharply at the boundary between the overlapping portion OL and the non-overlapping portion NOL in the piezoelectric layer 34*b*. This makes the boundary between the overlapping portion OL and the non-overlapping portion NOL prone to cracking, etc.

In order to prevent cracking, etc. described above from occurring, it is conceivable that a liquid adhesive for bonding the protective substrate 35 to the diaphragm 33 is applied from a region on the non-overlapping portion NOL to the second electrode 34*c* over the overlapping portion OL of the piezoelectric layer 34*b*. The applied adhesive, after curing or solidification, serves as a crack-preventing structure. However, the adhesive might not be able to be applied stably because it is necessary to apply the adhesive, which is a fluid, to a region from the piezoelectric layer 34*b* to the second electrode 34*c*.

An alternative conceivable approach is to make a portion that is in contact with the boundary between the overlapping portion OL and the non-overlapping portion NOL, of each first electrode 34*a*, narrower. Making this portion narrower reduces a portion where distortional operation occurs at the overlapping portion OL in the neighborhood of the boundary in the piezoelectric layer 34*b*. However, even if a portion where distortional operation occurs is reduced, the fact remains that it is prone to cracking, etc.

Another alternative conceivable approach is to form a wiring pattern that bypasses the boundary between the overlapping portion OL and the non-overlapping portion NOL for each first electrode 34*a*. If this approach is taken, a space for forming the wiring pattern that bypasses the boundary on the diaphragm 33 is necessary.

Still another alternative conceivable approach is to form a protective film such as a film of $AlO_x$ from a region on the non-overlapping portion NOL to the second electrode 34*c* over the overlapping portion OL of the piezoelectric layer 34*b*. If this approach is taken, there is a possibility that the piezoelectric layer 34*b* might be deteriorated in the process of forming the protective film on the non-overlapping portion NOL where the piezoelectric layer 34*b* is exposed.

To provide a solution, in the specific example described here, the first portion P1 of the second electrode 34*c*, which is a conductive portion that is next to the piezoelectric layer 34*b* in the +Z direction, is configured to be thin in the neighborhood of the end E1 of the second electrode 34*c*. This structure prevents a problem such as the development of a crack from occurring. With reference to FIGS. 4 and 5, an example of the structure of the actuator 12 including the piezoelectric element 34 will now be explained. The actuator 12 illustrated in FIGS. 4 and 5 includes the diaphragm 33 and the piezoelectric element 34.

As illustrated in FIG. 4, in a cross section orthogonal to the X axis, each piezoelectric element 34 includes the first electrode 34*a*, which is located at a position partially overlapping with the corresponding pressure compartment Cl, the piezoelectric layer 34*b*, by which the first electrode 34*a* is covered, and the second electrode 34*c*, which is common to the plurality of pressure compartments Cl. An individual drive signal is supplied to each first electrode 34*a*. The second electrode 34*c* includes a portion that is in contact with the diaphragm 33 each between two adjacent regions of the piezoelectric layer 34*b* in the Y-axis direction. A reference potential that is a fixed potential is supplied to the second electrode 34*c*. Therefore, a voltage that is a difference between the reference potential supplied to the second electrode 34*c* and the potential of the drive signal supplied to the first electrode 34*a* is applied to the piezoelectric layer 34*b*. The potential of the drive signal corresponds to an ejection amount of the liquid droplet DR. A ground potential may be supplied to the second electrode 34*c*.

As illustrated in FIG. 5, at a region where the second electrode 34*c* overlaps, the actuator 12 includes the diaphragm 33, the first electrode 34*a*, the piezoelectric layer 34*b*, and the second electrode 34*c* in this order in the +Z direction. The diaphragm 33 is provided throughout the entire area of the pressure compartment substrate 32. The first electrode 34*a* is formed as a layer on the diaphragm 33 from a portion overlapping with the pressure compartment Cl to a portion not overlapping with the pressure compartment Cl in the X-axis direction. As described above, the piezoelectric layer 34*b* includes the pressure compartment corresponding area AC1 and the pressure compartment non-corresponding area AC0 and is formed as a layer on the first electrode 34*a*. In the first electrode 34*a*, there is a portion where the piezoelectric layer 34*b* does not overlap. The end E2 of the piezoelectric layer 34*b* located in the pressure compartment non-corresponding area AC0 is covered by the third electrode 37. The third electrode 37 is covered by a lead wire 52*b* for supplying a drive signal. The second electrode 34*c* is provided on the piezoelectric layer 34*b* across a boundary between the pressure compartment corresponding area AC1 and the pressure compartment non-corresponding area AC0. In the pressure compartment non-corresponding area AC0 of the piezoelectric layer 34*b*, there is a portion where the second electrode 34*c* does not overlap. The end E1 of the second electrode 34*c* is distant from the third electrode 37 in the X-axis direction. A lead wire 52*a* for supplying a reference potential is provided on a part of the second electrode 34*c*. The lead wire 52 is a collective term for the lead wires 52*a* and 52*b*.

As illustrated in FIGS. 5 and 6, the second electrode 34*c* includes the first portion P1 that is electrically conductive, the second portion P2 that is less conductive than the first portion P1, and the third portion P3 that is more conductive than the second portion P2. For example, if the principal component of the first portion P1 is iridium, the first portion P1 is electrically conductive. The first portion P1 is next to the piezoelectric layer 34*b* in the +Z direction. To facilitate an explanation, the boundary between the first portion P1 and the third portion P3 is indicated by a broken line in FIG. 6. A length in the +Z direction is defined herein as a thickness. The first portion P1 includes the first thickness portion T1, which is located at the first position L1 in the X-axis direction orthogonal to the +Z direction, and the second thickness portion T2, which is located at the second position L2 that is closer to the end E1 of the second electrode 34*c* in the X-axis direction than the first position L1 is. The second thickness portion T2, which is relatively near the end E1 of the second electrode 34*c*, is thinner than the first thickness portion T1. The liquid ejecting head 10 including the actuator 12 has a feature that the thickness t2 of the first portion P1 at the second position L2 is less than the thickness t1 of the first portion P1 at the first position L1.

In the specific example described here, the +Z direction is an example of a first direction, and the X-axis direction is an example of a second direction intersecting with the first direction. Therefore, the first portion P1 includes the first thickness portion T1, which is located at the first position L1 in the second direction intersecting with the first direction, and the second thickness portion T2, which is located at the second position L2 that is closer to the end E1 of the second electrode 34*c* in the second direction than the first position L1 is. The second thickness portion T2 is thinner than the first thickness portion T1. Because of this structure, the electric resistance of the second thickness portion T2, which is relatively near the end E1, is higher than that of the first thickness portion T1. That is, the electric resistance of the first portion P1 at the second position L2 is higher than that at the first position L1. Since the voltage level of a drive pulse changes, the voltage applied to the piezoelectric layer 34*b* is akin to an alternating-current voltage. Charging and discharging of electric charges are inhibited to some extent by the second thickness portion T2, the electric resistance of which is higher, that is, at the second position L2 in the first portion P1. Therefore, in the pressure compartment non-corresponding area AC0 of the piezoelectric layer 34*b*, the applied voltage in the neighborhood of the boundary between the overlapping portion OL and the non-overlapping portion NOL changes gently. Therefore, the change in distortion at the boundary between the overlapping portion OL and the non-overlapping portion NOL in the piezoelectric layer 34*b* is gentle. This prevents a problem such as the development of a crack from occurring at the boundary between the overlapping portion OL and the non-overlapping portion NOL.

In the second electrode 34*c*, the second portion P2, which is less conductive than the first portion P1, is next to the first portion P1 in the +Z direction. For example, if the principal component of the second portion P2 is $TiO_x$ or $TaO_x$, the second portion P2 is less conductive than the first portion P1. It will be advantageous if the second portion P2 is made of an insulating substance such as $TiO_x$, $AlO_x$, $SiO_x$, or the like. The second portion P2 exists at the second position L2, which is relatively near the end E1 of the second electrode 34*c*, and does not exist at the first position L1. If the second portion P2 is less conductive than the first portion P1, the electric resistance of a layered portion made up of the second portion P2 and the second thickness portion T2 in the first portion P1 is determined mainly depending on the electric resistance of the second thickness portion T2. Due to the higher electric resistance of the second thickness portion T2, in the pressure compartment non-corresponding area AC0 of the piezoelectric layer 34*b*, the applied voltage in the neighborhood of the boundary between the overlapping portion OL and the non-overlapping portion NOL changes gently. This prevents a problem such as the development of a crack from occurring at the boundary between the overlapping portion OL and the non-overlapping portion NOL in the piezoelectric layer 34*b*. Moreover, since the second portion P2 located at the second position L2 serves as a structure component that enhances the strength of the piezoelectric layer 34*b*, it is possible to effectively prevent a problem such as the development of a crack from occurring at the boundary between the overlapping portion OL and the non-overlapping portion NOL.

It will be advantageous if the Young's modulus of the second portion P2, which is less conductive, is greater than that of the first portion P1, which is more conductive. For example, if the principal component of the first portion P1 is iridium and the principal component of the second portion P2 is $TiO_x$, the second portion P2 has a greater Young's modulus than the first portion P1. If the second portion P2 has a greater Young's modulus than the first portion P1, it is possible to effectively prevent a problem such as the development of a crack from occurring at the boundary between the overlapping portion OL and the non-overlapping portion NOL in the piezoelectric layer 34*b*.

It will be advantageous if the Young's modulus of the second portion P2 is greater than that of the third portion P3, which is more conductive. For example, if the principal component of the third portion P3 is iridium and the principal component of the second portion P2 is $TiO_x$, the second portion P2 has a greater Young's modulus than the third portion P3.

It will be advantageous if the second portion P2, which is less conductive, has a compressive stress. For example, if the second portion P2 is an oxide film such as $TiO_x$, $TaO_x$, $AlO_x$, $ZrO_x$, or $SiO_x$, etc., the second portion P2 has a compressive stress. An oxide film of these kinds is compressively stressed strongly if formed by thermal oxidation of a metal film. The piezoelectric layer 34*b* is prone to cracking when a force is applied in a direction of contracting in the X-axis direction due to the distortional operation of the overlapping portion OL. The second portion P2 that has a compressive stress applies a force for widening the layer-boundary surface of the piezoelectric layer 34*b* in the X-axis direction through the first portion P1. Therefore, the contraction of the piezoelectric layer 34*b* in the X-axis direction is suppressed. For this reason, if the second portion P2 has a compressive stress, it is possible to effectively prevent a problem such as the development of a crack from occurring at the boundary between the overlapping portion OL and the non-overlapping portion NOL in the piezoelectric layer 34*b*.

As illustrated in FIG. 5, the lead wire 52*a* is not stacked on a part of the second electrode 34*c*. Therefore, the electric resistance of the part of the second electrode 34*c* where the lead wire 52*a* is not stacked is higher than that of a stack made up of the second electrode 34*c* and the lead wire 52*a*. For this reason, if the second portion P2, which is less conductive, were not provided in the second electrode 34*c*, the piezoelectric layer 34*b* would be prone to cracking at its part that is in contact with the boundary between the part of the second electrode 34*c* where the lead wire 52*a* is stacked and the part of the second electrode 34*c* where the lead wire 52*a* is not stacked. Since the second portion P2 is located throughout the region from the part of the second electrode 34*c* where the lead wire 52*a* is not stacked to the part of the second electrode 34*c* where the lead wire 52*a* is stacked, it is possible to prevent a crack from being developed in the piezoelectric layer 34*b* due to the lead wire 52*a*.

In the second electrode 34*c*, the third portion P3, which is more conductive than the second portion P2, exists at the second position L2, which is relatively near the end E1 of the second electrode 34*c*, and does not exist at the first position L1. The third portion P3 is next to the second portion P2 in the +Z direction. For example, if the principal component of the third portion P3 is iridium, the third portion P3 is more conductive than the second portion P2. Furthermore, if the third portion P3 is thicker than the second thickness portion T2 in the first portion P1, the conductive property of the first thickness portion T1 in the first portion P1 is substantially equal to the conductive property of the third portion P3. The substantial equality between the conductive property of the first thickness portion T1 and the conductive property of the third portion P3 mentioned here means that a ratio of the electric conductivity of the third portion P3 to the electric conductivity of the first thickness portion T1 is 0.8 or higher and 1.2 or lower.

In the specific example described here, the principal component of the first portion P1 is the same as the principal component of the third portion P3. Of course, the principal component of the third portion P3 may be the same as the principal component of the second thickness portion T2 in the first portion P1 or may be different therefrom. For example, it is possible to choose a certain kind of precious metal such as iridium or platinum as the principal component of the second thickness portion T2, which is next to the piezoelectric layer 34*b* in the +Z direction, and choose a certain kind of low-cost metal such as aluminum or tungsten as the principal component of the third portion P3, which is away from the piezoelectric layer 34*b*. Even if these materials are used, it is possible to sufficiently set the second electrode 34*c*, which is next to the piezoelectric layer 34*b* in the +Z direction, at a reference level and thus apply a drive pulse with an appropriate voltage to the piezoelectric layer 34*b*. Therefore, it is possible to reduce the cost of the liquid ejecting head 10.

As illustrated in FIGS. 5 and 6, at the first position L1 where the first thickness portion T1 in the first portion P1 exists, the second electrode 34*c* is substantially composed only of the first portion P1. The meaning of "the second electrode 34*c* is composed only of the first portion P1" encompasses, but is not limited to, a case where the second electrode 34*c* contains an impurity. For example, there is a possibility that a part of the material of the second portion P2 might turn into an impurity by being left at the first position L1 during the processes of manufacturing the actuator 12. The content of the impurity in the second electrode 34*c* is less than the content of the first portion P1, as a matter of course. Specifically, the content of the impurity in the second electrode 34*c* is 10 mol % or less. Since the second electrode 34*c* is composed only of the first portion P1, a drive pulse with a sufficient voltage is applied to the pressure compartment corresponding area AC1 of the piezoelectric layer 34*b*.

At the second position L2 where the second thickness portion T2 in the first portion P1 exists, the second electrode 34*c* includes the first portion P1, the second portion P2 formed on the first portion P1, and the third portion P3 formed on the second portion P2 in this order in the +Z direction. Since the second thickness portion T2 is thinner than the first thickness portion T1, the electric resistance of the second thickness portion T2 is higher than that of the first thickness portion T1, making the change in distortion at the boundary between the overlapping portion OL and the non-overlapping portion NOL in the piezoelectric layer 34*b* gentle. Moreover, since the second portion P2, which is less conductive, is formed on the second thickness portion T2, the second portion P2 serves as a structure component that enhances the strength of the piezoelectric layer 34*b*.

A third thickness portion T3 located at the second position L2 in the third portion P3 illustrated in FIGS. 5 and 6 is thinner than the first thickness portion T1 located at the first position L1 in the first portion P1 and is thicker than the second thickness portion T2 located at the second position L2 in the first portion P1. Therefore, the thickness t2 of the first portion P1 at the second position L2 is less than the thickness t3 of the third portion P3 at the second position L2. In other words, the second thickness portion T2 is thinner than the third thickness portion T3, which is thinner than the first thickness portion T1. Therefore, the electric resistance of the second thickness portion T2 is higher than that of the third thickness portion T3, and, in the pressure compartment non-corresponding area AC0 of the piezoelectric layer 34*b*, the applied voltage in the neighborhood of the boundary between the overlapping portion OL and the non-overlapping portion NOL changes gently. This prevents a problem such as the development of a crack from occurring at the boundary between the overlapping portion OL and the non-overlapping portion NOL. Moreover, since the third portion P3 located at the second position L2 serves as a structure component that enhances the strength of the piezoelectric layer 34*b*, it is possible to effectively prevent a problem such as the development of a crack from occurring at the boundary between the overlapping portion OL and the non-overlapping portion NOL.

The thickness t1 of the first thickness portion T1 in the first portion P1 of the second electrode 34*c* may be approximately 15 to 30 nm. The thickness t2 of the second thickness portion T2 in the first portion P1 of the second electrode 34*c* may be approximately 3 to 6 nm. The thickness tp2 of the second portion P2 of the second electrode 34*c* may be approximately 10 to 50 nm. The thickness t3 of the third portion P3 of the second electrode 34*c* may be approximately 9 to 27 nm.

In the second electrode 34*c* illustrated in FIGS. 5 and 6, the sum of the thickness of the second thickness portion T2 in the first portion P1 and the thickness of the third thickness portion T3 in the third portion P3, t2+t3, is substantially equal to the thickness t1 of the first thickness portion T1 in the first portion P1. Therefore, the sum of the thickness of the first portion P1 at the second position L2 and the thickness of the third portion P3 thereat, t2+t3, is substantially equal to the thickness t1 of the first portion P1 at the first position L1. The substantial equality between the sum of the thickness t2+t3 and the thickness t1 of the first portion P1 mentioned here means that a ratio (t2+t3)/t1 is 0.8 or higher and 1.2 or lower. If the sum of the thickness t2+t3 is substantially equal to the thickness t1 of the first portion P1, it is possible to effectively prevent a problem such as the development of a crack from occurring at the boundary between the overlapping portion OL and the non-overlapping portion NOL in the piezoelectric layer 34*b*.

As illustrated in FIG. 5, at a third position L3 that is closer to the end E2 of the piezoelectric layer 34*b* in the X-axis direction than the first position L1 and the second position L2 are, the piezoelectric layer 34*b* exists, and the second electrode 34*c* does not exist. Since the second thickness portion T2 located at the second position L2 in the first portion P1 of the second electrode 34*c* is electrically conductive, when a predetermined voltage is applied between the first electrode 34*a* and the second electrode 34*c*, the amount of distortion of the piezoelectric layer 34*b* at the second position L2 is larger than the amount of distortion of the piezoelectric layer 34*b* at the third position L3. Moreover, since the electric resistance of the second thickness portion T2 located at the second position L2 in the first portion P1 is higher than that of the first thickness portion T1 located at the first position L1 in the first portion P1, when a predetermined voltage is applied between the first electrode 34*a* and the second electrode 34*c*, the amount of distortion of the piezoelectric layer 34*b* at the second position L2 is smaller than the amount of distortion of the piezoelectric layer 34*b* at the first position L1.

As described above, when a predetermined voltage is applied between the first electrode 34*a* and the second electrode 34*c*, the amount of distortion of the piezoelectric layer 34*b* at the second position L2 is smaller than the amount of distortion of the piezoelectric layer 34*b* at the first position L1 and is larger than the amount of distortion of the piezoelectric layer 34*b* at the third position L3. Since this suppresses a sharp change in distortion at the boundary between the overlapping portion OL and the non-overlapping portion NOL in the piezoelectric layer 34*b*, a problem such as the development of a crack is unlikely to occur at the boundary between the overlapping portion OL and the non-overlapping portion NOL.

The actuator 12 illustrated in FIG. 5 further includes the third electrode 37. The third electrode 37 includes the continuing portion 38, which is next to the piezoelectric layer 34*b* in the +Z direction, and a covering portion 39, by which the end E2 of the piezoelectric layer 34*b* is covered. The second electrode 34*c* and the third electrode 37 are at a distance from each other in the X-axis direction. Therefore, the actuator 12 is configured such that an electric current does not flow between the second electrode 34*c* and the third electrode 37.

Figure 8:
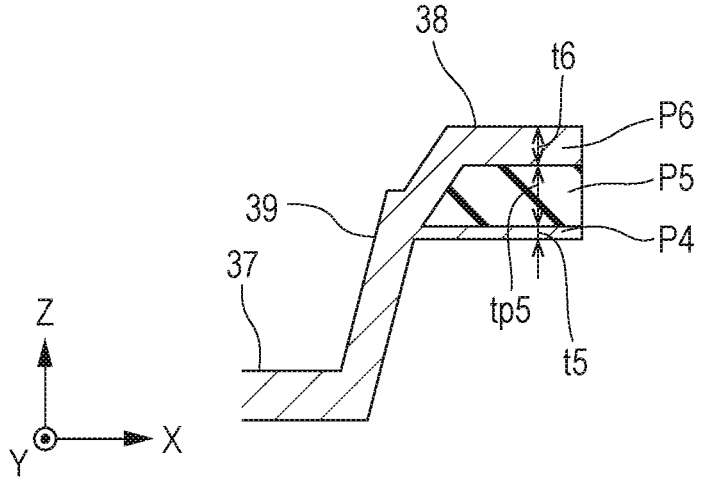
FIG. 8 is a sectional view that schematically illustrates an example of the structure of an essential part of the third electrode that includes the fifth portion, taken at a position along the line VIII-VIII of FIG. 2.

In the process of forming the second portion P2, which is less conductive, it is possible to form a portion that is less conductive in the third electrode 37, too. FIGS. 7 and 8 schematically illustrate an example in which a portion that is less conductive is formed in the third electrode 37.

FIG. 7 is a sectional view that schematically illustrates an example of the structure of an essential part of the liquid ejecting head 10, taken at a position along the line VII-VII of FIG. 2, wherein the third electrode 37 includes the fifth portion P5 that is less conductive. FIG. 8 is a sectional view that schematically illustrates an example of the structure of an essential part of the third electrode 37 that includes the fifth portion P5, taken at a position along the line VIII-VIII of FIG. 2. In order to facilitate the understanding of the structure of the third electrode 37, the hatching of the fourth portion P4 and the sixth portion P6 is omitted in FIG. 8.

The continuing portion 38 of the third electrode 37 illustrated in FIGS. 7 and 8 includes the fourth portion P4 that is electrically conductive, the sixth portion P6 that is electrically conductive, and the fifth portion P5 that is less conductive than the fourth portion P4 and the sixth portion P6. At a region where the sixth portion P6 overlaps, the piezoelectric element 34 includes the first electrode 34*a*, the piezoelectric layer 34*b*, the fourth portion P4, the fifth portion P5, and the sixth portion P6 in this order in the +Z direction. The lead wire 52*b*, which is next to the third electrode 37 in the +Z direction, is provided on a part of the sixth portion P6. The sixth portion P6 has a part that is closer to the second electrode 34*c* than the lead wire 52*b* is. This part of the sixth portion P6 is exposed and is not covered by the lead wire 52*b*. In the X-axis direction, the distance between the fifth portion P5, which is less conductive, and the second electrode 34*c* is shorter than the distance between the lead wire 52*b* and the second electrode 34*c*.

The thickness t5 of the fourth portion P4 of the continuing portion 38 is substantially equal to the thickness t2 of the first portion P1 of the second electrode 34*c*. The thickness tp5 of the fifth portion P5 of the continuing portion 38 is substantially equal to the thickness tp2 of the second portion P2 of the second electrode 34*c*. Similarly to the second portion P2 of the second electrode 34*c*, for example, $TiO_x$, $TaO_x$, $AlO_x$, $ZrO_x$, or $SiO_x$, etc. can be used as the material of the fifth portion P5, which is less conductive. The thickness t6 of the sixth portion P6 of the continuing portion 38 is substantially equal to the thickness t3 of the third portion P3 of the second electrode 34*c*. When it is stated that the thickness of a certain portion is equal to the thickness of another portion, the statement means that a ratio therebetween is 0.8 or higher and 1.2 or lower.

The fourth portion P4 of the continuing portion 38 has conductive property that is substantially equal to the conductive property of the second thickness portion T2 in the first portion P1 of the second electrode 34*c*, and is next to the piezoelectric layer 34*b* in the +Z direction. The fourth portion P4 is thin, similarly to the second thickness portion T2 of the second electrode 34*c*. Therefore, the electric resistance of the fourth portion P4 is higher than that of the first thickness portion T1 in the first portion P1 of the second electrode 34*c*. The higher electric resistance of the fourth portion P4 prevents migration, a phenomenon of an electric current flow between the second electrode 34*c* and the third electrode 37, from occurring.

The fifth portion P5 of the continuing portion 38 is less conductive than the fourth portion P4 and is next to the fourth portion P4 in the +Z direction. For example, if the principal component of the fifth portion P5 is $TiO_x$ or $TaO_x$, the fifth portion P5 is less conductive than the fourth portion P4. It will be advantageous if the fifth portion P5 is made of an insulating substance such as $TiO_x$, $AlO_x$, $SiO_x$, or the like. Since the continuing portion 38 of the third electrode 37 has the fifth portion P5, which is less conductive, electric field intensity between the second electrode 34*c* and the third electrode 37 decreases, and migration, a phenomenon of an electric current flow between the second electrode 34*c* and the third electrode 37, is prevented effectively. In particular, since the distance between the fifth portion P5 and the second electrode 34*c* is shorter than the distance between the lead wire 52*b* and the second electrode 34*c* in the X-axis direction, the migration mentioned here is prevented effectively.

The sixth portion P6 of the continuing portion 38 has conductive property that is substantially equal to the conductive property of the third portion P3 of the second electrode 34*c*, and is next to the fifth portion P5 in the +Z direction. Since the lead wire 52*b* is next to the sixth portion P6 in the +Z direction, wiring for supplying a drive signal to the piezoelectric layer 34*b* through the third electrode 37 and the first electrode 34*a* is formed efficiently.

The principal component of the sixth portion P6 may be the same as the principal component of the fourth portion P4 or may be different therefrom. For example, it is possible to choose a certain kind of precious metal such as iridium or platinum as the principal component of the fourth portion P4, which is next to the piezoelectric layer 34*b* in the +Z direction, and choose a certain kind of low-cost metal such as aluminum or tungsten as the principal component of the sixth portion P6, which is away from the piezoelectric layer 34*b*.

4. SPECIFIC EXAMPLES OF A METHOD FOR MANUFACTURING THE LIQUID EJECTING HEAD

FIGS. 9 to 16 are sectional views that schematically illustrate a specific example of a method for manufacturing the liquid ejecting head 10 illustrated in FIG. 5. FIGS. 17 to 20 are sectional views that schematically illustrate a specific example of a method for manufacturing the liquid ejecting head 10 illustrated in FIG. 7. To facilitate an explanation, the positions L1, L2, and L3 are illustrated in FIGS. 10 to 20, and the pressure compartment corresponding area AC1, the pressure compartment non-corresponding area AC0, the overlapping portion OL, and the non-overlapping portion NOL are illustrated in FIGS. 11 to 20. The illustration in FIGS. 10 to 20 is relatively enlarged in comparison with FIG. 9. A part of a pressure compartment substrate wafer 132 in the Z-axis direction is not illustrated in FIGS. 10 to 20.

Figure 9:
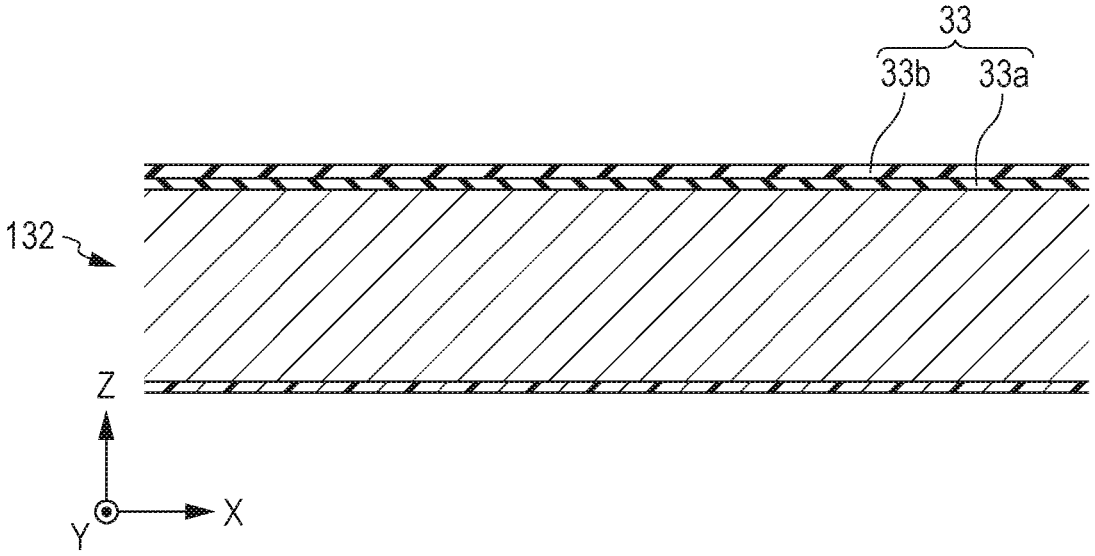
FIG. 9 is a sectional view that schematically illustrates an example of forming a diaphragm.

The pressure compartment substrate 32 is produced from a silicon wafer made of monocrystalline silicon. First, as illustrated in FIG. 9, a diaphragm forming step is performed. In the diaphragm forming step, the diaphragm 33 is formed on one surface of the pressure compartment substrate wafer 132, which is a silicon wafer. The diaphragm forming step according to the specific example described here includes an elastic layer forming step, in which the elastic layer 33*a* made of $SiO_x$ is formed by thermally oxidizing the pressure compartment substrate wafer 132, and an insulating layer forming step, in which the insulating layer 33*b* made of $ZrO_x$ is formed by thermally oxidizing the pressure compartment substrate wafer 132 having the elastic layer 33*a* after film deposition by sputtering. Of course, the method for forming the elastic layer 33*a* is not limited to thermal oxidation. A physical vapor growth method such as sputtering, a CVD method, a vacuum deposition method, a liquid-phase method such as spin coating, or a combination of any of them, etc. may be used. The insulating layer 33*b* may be formed using a CVD method, a vacuum deposition method, a liquid-phase method such as spin coating, or a combination of any of them.

Figure 10:
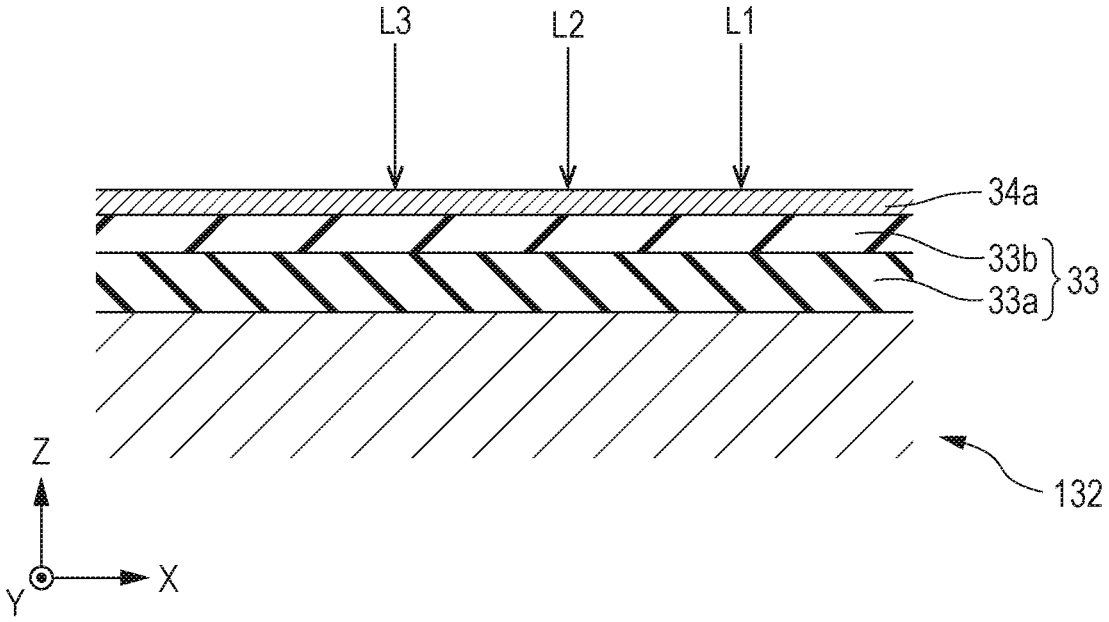
FIG. 10 is a sectional view that schematically illustrates an example of forming a first electrode.
Figure 11:
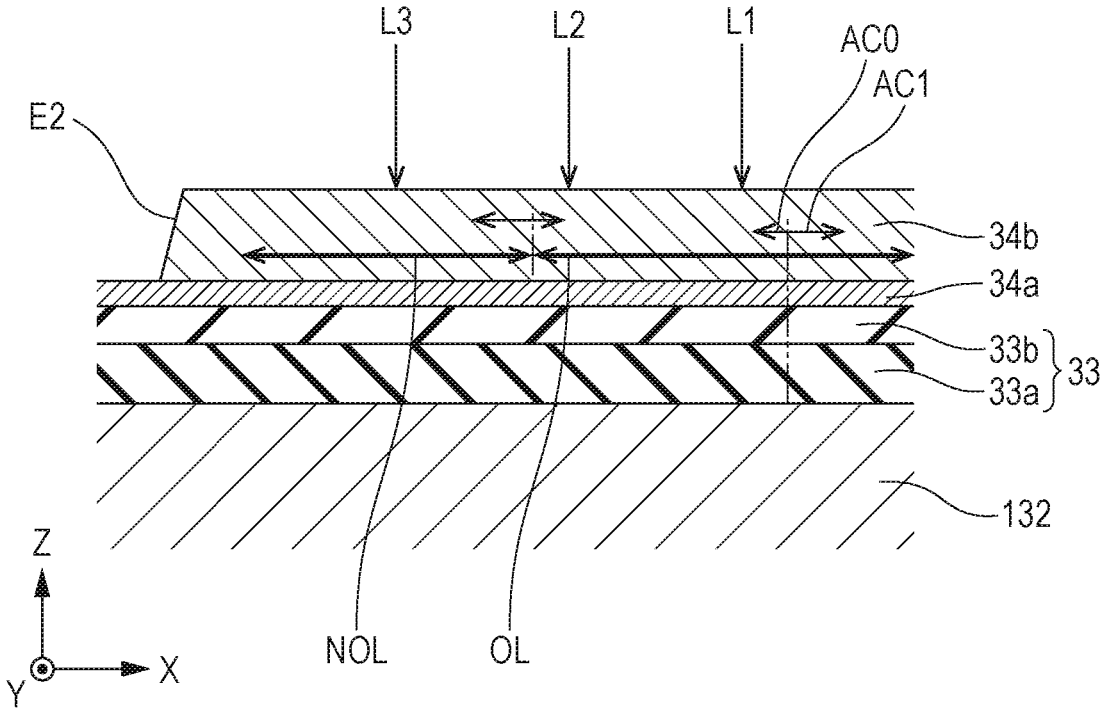
FIG. 11 is a sectional view that schematically illustrates an example of forming a piezoelectric layer.

Next, a layering step is performed. As illustrated in FIGS. 10 and 11, in the layering step, the first electrode 34*a* and the piezoelectric layer 34*b* are formed in layers in this order over the diaphragm 33. The layering step includes a first electrode forming step, in which the first electrode 34*a* is formed on the diaphragm 33, and a piezoelectric layer forming step, in which the piezoelectric layer 34*b* is formed on the first electrode 34*a*.

FIG. 10 schematically illustrates an example of forming the first electrode 34*a* on the diaphragm 33 in the first electrode forming step. It is possible to form the first electrode 34*a* by, for example, performing a film deposition step of depositing a film of metal such as iridium or platinum and a patterning step of patterning the deposited film of metal. A physical vapor growth method, for example, sputtering, etc. can be used for depositing the film of metal. Lithography, etc. can be used for the patterning.

FIG. 11 schematically illustrates an example of forming the piezoelectric layer 34*b* on the first electrode 34*a* in the piezoelectric layer forming step. For example, a sol-gel method, an MOD method, a physical vapor growth method such as sputtering or laser ablation, etc. can be used for forming the piezoelectric layer 34*b* before patterning. MOD is an acronym for Metal Organic Decomposition. To pattern the piezoelectric layer 34*b*, lithography, etc. can be used.

Figure 12:
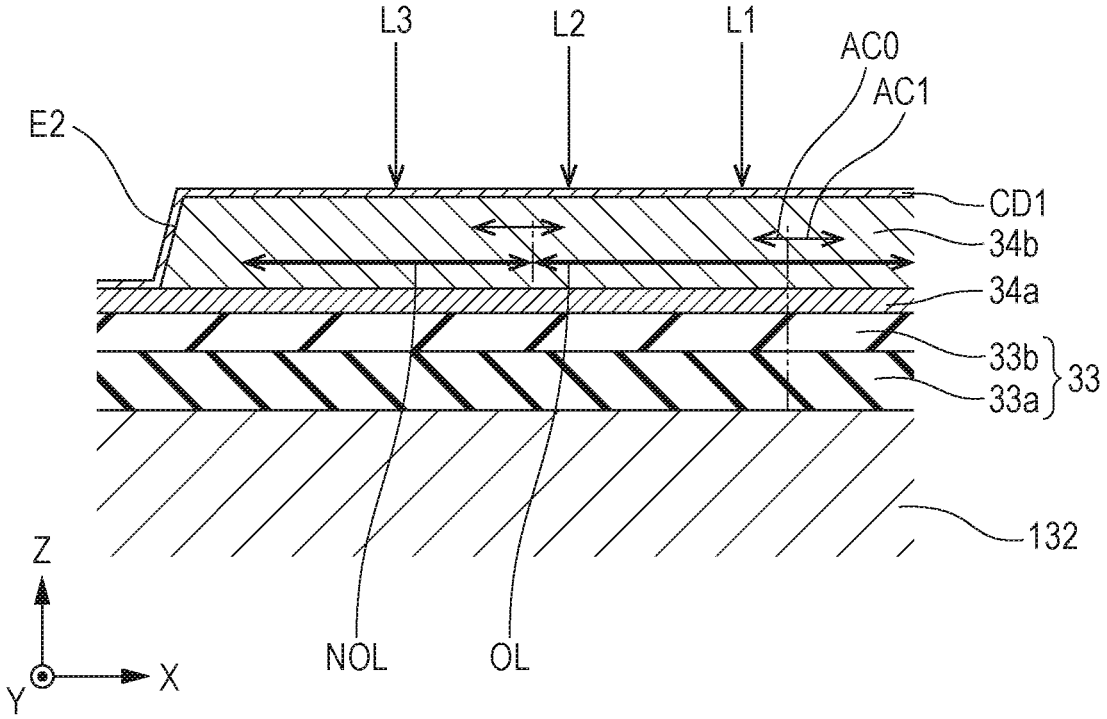
FIG. 12 is a sectional view that schematically illustrates an example of forming a first conductive portion.

Next, as illustrated in FIG. 12, a first conductive portion forming step is performed. In the first conductive portion forming step, the first conductive portion CD1 is formed on the piezoelectric layer 34*b* and on a part of the first electrode 34*a*, wherein the piezoelectric layer 34*b* is not formed on this part. The thickness of the first conductive portion CD1 is configured to be the same as the thickness t2 of the second thickness portion T2 in the first portion P1 of the second electrode 34*c* as illustrated in FIG. 6. It is possible to form the first conductive portion CD1 by, for example, depositing a film of metal such as iridium or platinum. A physical vapor growth method, for example, sputtering, etc. can be used for depositing the film of metal. As a result of performing the first conductive portion forming step, the first conductive portion CD1 that is next to the piezoelectric layer 34*b* in the +Z direction is formed.

Figure 13:
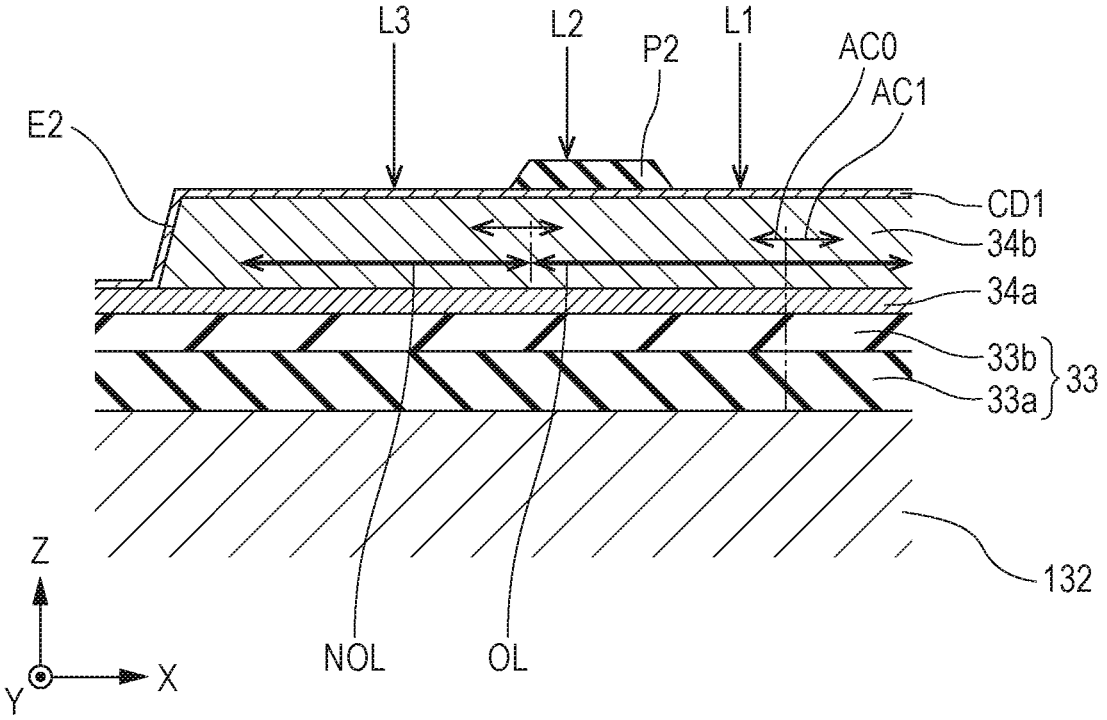
FIG. 13 is a sectional view that schematically illustrates an example of forming a second portion.

Next, as illustrated in FIG. 13, a second portion forming step is performed. In the second portion forming step, the second portion P2 that is next to the first conductive portion CD1 in the +Z direction is formed at the second position L2, and the second portion P2 is not formed at the first position L1. The second portion P2 is less conductive than the first conductive portion CD1. The second portion P2 before patterning can be formed by, for example, a physical vapor growth method such as sputtering, a CVD method, a vacuum deposition method, a liquid-phase method such as spin coating, or a combination of any of them and thermal oxidation, etc. For example, if the principal component of the second portion P2 is $TaO_x$, it is possible to form a film of the second portion P2 before patterning by sputtering. If the principal component of the second portion P2 is $TiO_x$, it is possible to form the second portion P2 before patterning, the principal component of which is $TiO_x$, by forming a film of titanium by sputtering, and then by thermally oxidizing the film of titanium. It is possible to form the second portion P2 before patterning can be formed in a similar manner also in a case where thermal oxidation is performed after forming a film of metal such as aluminum or zirconium, etc. A strong compressive stress is applied to the second portion P2 if thermal oxidation is performed in the second portion forming step. Lithography, etc. can be used for the patterning.

The second portion P2 for preventing a crack from being developed in the piezoelectric layer 34*b* is not formed directly on the piezoelectric layer 34*b* but formed on the first conductive portion CD1, thereby being distanced from the piezoelectric layer 34*b* in the +Z direction. Therefore, degradation that might occur if a protective film were formed directly on the piezoelectric layer 34*b* is prevented.

Figure 14:
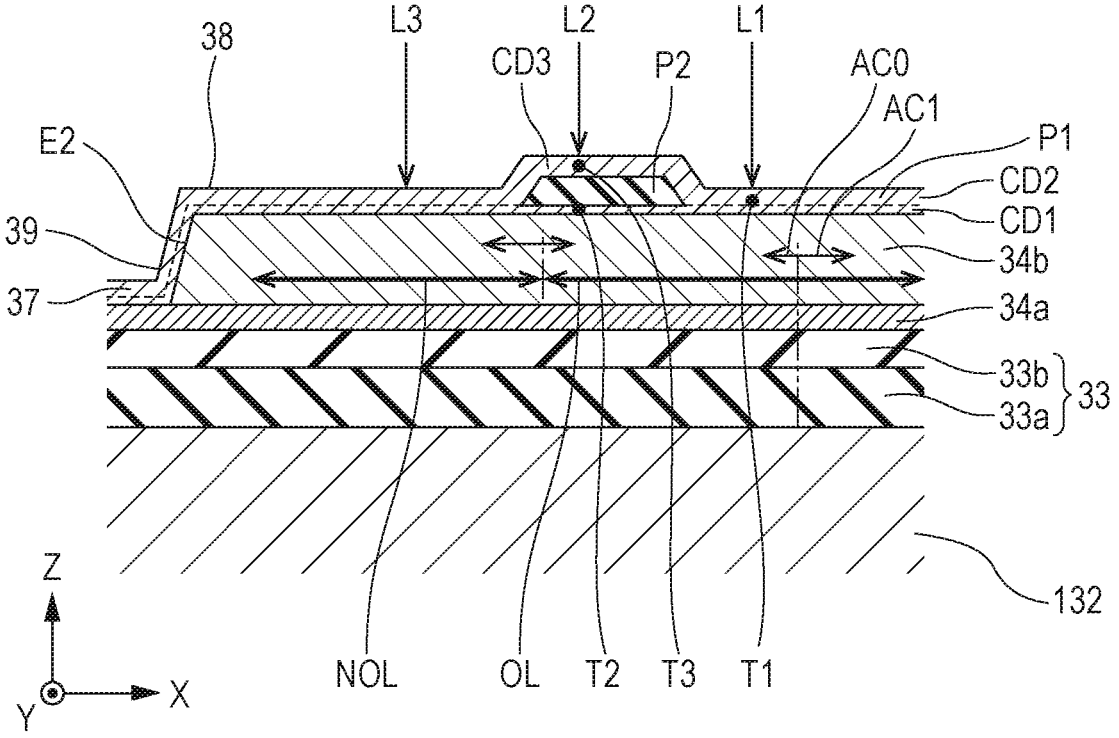
FIG. 14 is a sectional view that schematically illustrates an example of forming a second conductive portion and a third conductive portion.
Figure 15:
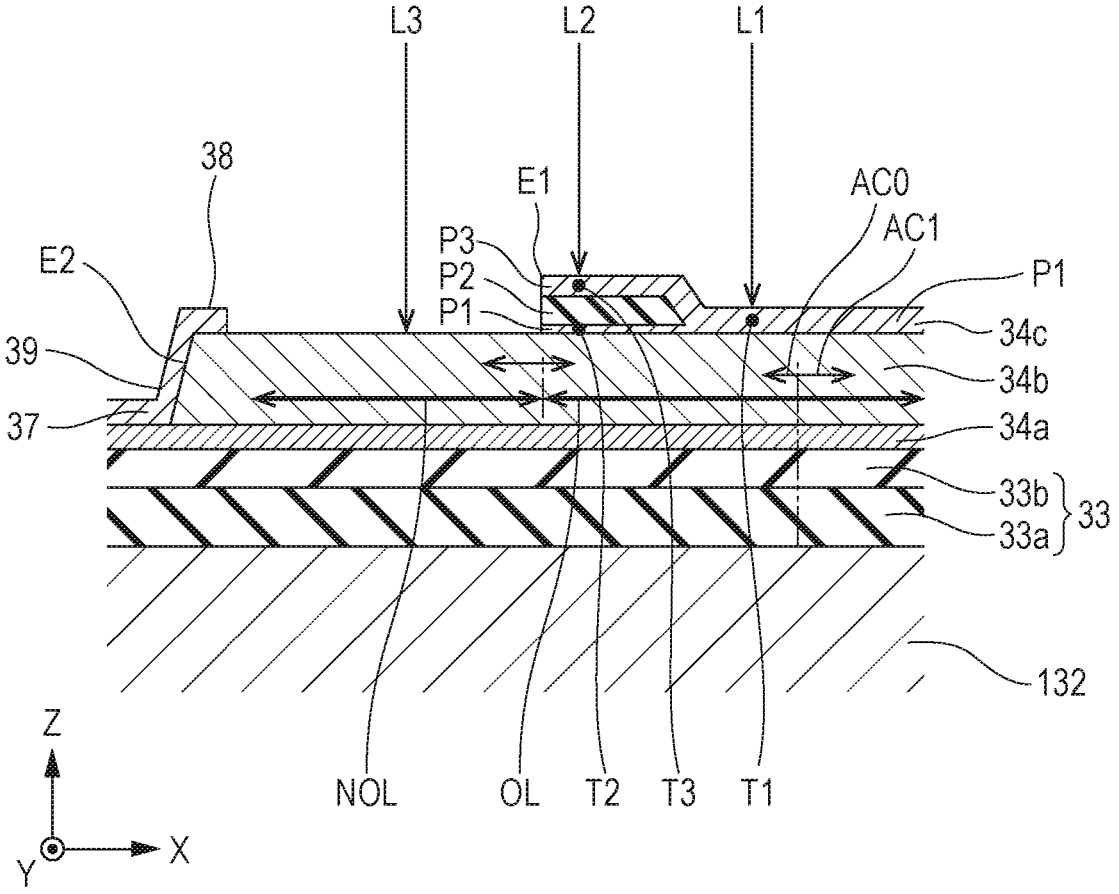
FIG. 15 is a sectional view that schematically illustrates an example of forming the second electrode and the third electrode.

Next, as illustrated in FIGS. 14 and 15, a second conductive portion forming step of forming the second conductive portion CD2 is performed. The second conductive portion forming step includes a second conductive portion layering step, in which a layer of the second conductive portion CD2 is formed, a third conductive portion layering step, in which a layer of a third conductive portion CD3 is formed, and a patterning step.

FIG. 14 schematically illustrates an example of forming the third conductive portion CD3 on the second portion P2 in the third conductive portion layering step and forming the second conductive portion CD2 on a part of the first conductive portion CD1 in the second conductive portion layering step, wherein this part is the part on which the layer of the second portion P2 has not been formed. The thickness of the second conductive portion CD2 and the thickness of the third conductive portion CD3 are configured to be the same as the thickness t3 of the third thickness portion T3 in the third portion P3 of the second electrode 34*c* as illustrated in FIG. 6. It is possible to form the second conductive portion CD2 and the third conductive portion CD3 by depositing a film of metal such as iridium or aluminum, etc. A physical vapor growth method, for example, sputtering, etc. can be used for depositing the film of metal.

FIG. 15 schematically illustrates an example of forming the second electrode 34*c* and the third electrode 37 from the conductive portions CD1, CD2, and CD3 in the patterning step. Lithography, etc. can be used for the patterning. In the patterning step, the conductive portions CD1, CD2, and CD3 are removed from the pressure compartment non-corresponding area AC0 including the third position L3, the first conductive portion CD1 and the second conductive portion CD2 that are continuous from each other remain without being removed at the first position L1, the first conductive portion CD1 and the second portion P2 and the third conductive portion CD3 remain without being removed at the second position L2, and the first conductive portion CD1 and the second conductive portion CD2 are substantially not left at the third position L3. As a result of this patterning, the first thickness portion T1 in the first portion P1 of the second electrode 34*c* is formed on the piezoelectric layer 34*b* at the first position L1. At the second position L2, the second thickness portion T2 in the first portion P1 of the second electrode 34*c* is formed on the piezoelectric layer 34*b*, the second portion P2 that is less conductive in the second electrode 34*c* is formed on the second thickness portion T2, and the third portion P3 of the second electrode 34*c* is formed on the second portion P2. The second electrode 34*c* does not exist at the third position L3.

The second portion P2, which is less conductive, exists at the second position L2 and does not exist at the first position L1. Therefore, in the second conductive portion forming step, the second conductive portion CD2 that is next to the first conductive portion CD1 in the +Z direction is formed at the first position L1, and the second conductive portion CD2 is not formed at the second position L2. The third portion P3, which is next to the second portion P2 in the +Z direction, is formed at the second position L2 in the second conductive portion forming step.

Figure 16:
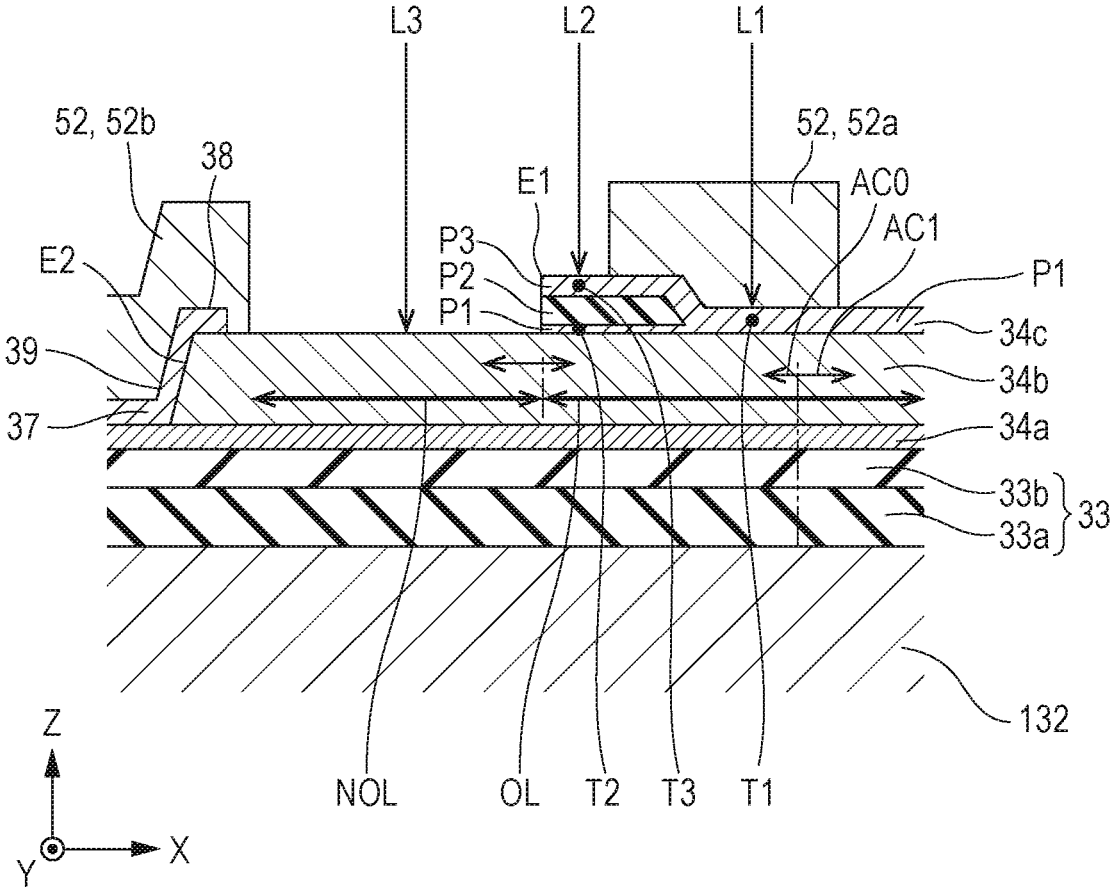
FIG. 16 is a sectional view that schematically illustrates an example of forming lead wires.

Next, a lead wire forming step, in which the lead wires 52 are formed as illustrated in FIG. 16, is performed. The lead wire forming step includes a lead wire stacking step, in which the lead wires 52 are stacked on the second electrode 34*c* and the third electrode 37 respectively, and a patterning step. It is possible to form the lead wires 52 by, for example, depositing a film of metal such as gold. A physical vapor growth method, for example, sputtering, etc. can be used for depositing the film of metal. Lithography, etc. can be used for the patterning. By going through the lead wire forming step, the lead wire 52*a* is stacked on a part of the second electrode 34*c*, and the lead wire 52*b* is stacked on the third electrode 37.

Next, a protective substrate bonding step, in which the protective substrate 35 illustrated in FIG. 3 is bonded to the insulating layer 33*b*, is performed. The protective substrate 35, which has the space 35*a* and the through hole 35*b*, can be manufactured from a protective substrate wafer, which is, for example, a silicon wafer. The method for forming the space 35*a* and the through hole 35*b* in the protective substrate wafer is not specifically limited. For example, the space 35*a* and the through hole 35*b* are formed with high precision by, for example, performing anisotropic etching of the protective substrate wafer through a mask. Alkaline solution such as potassium hydroxide solution can be used as an etchant. Of course, dry etching such as plasma etching may be used instead of wet etching for forming the space 35*a* and the through hole 35*b*. The protective substrate 35 is bonded to the insulating layer 33*b* by using, for example, an adhesive. A part of the protective substrate 35 is bonded to a part of the lead wires 52, with the adhesive applied therebetween.

Next, a pressure compartment substrate forming step, in which the pressure compartment substrate 32 before division is formed from the pressure compartment substrate wafer 132, is performed. The pressure compartment substrate forming step includes a thinning step, a pressure compartment forming step, and a dividing step. In the thinning step, the pressure compartment substrate wafer 132 is made thinner into a predetermined thickness by applying a thinning treatment thereto from the side that is the opposite of the side where the protective substrate 35 is provided. In the pressure compartment forming step, the pressure compartments Cl are formed in the thinned pressure compartment substrate wafer 132. In the dividing step, the pressure compartment substrate 32 and the protective substrate 35 are cut into a chip size. One or more kinds of method selected from the group including, for example, grinding, dry etching such as plasma etching, wet etching, CMP, and the like can be used for reducing the thickness of the pressure compartment substrate wafer 132. CMP is an acronym for Chemical Mechanical Polishing. The method for forming the pressure compartments Cl in the thinned pressure compartment substrate wafer 132 is not specifically limited. For example, the pressure compartments Cl are formed with high precision by, through a mask, performing anisotropic etching of the pressure compartment substrate wafer 132 from the side that is the opposite of the side where the protective substrate 35 is provided. Alkaline solution such as potassium hydroxide solution can be used as an etchant. Of course, dry etching such as plasma etching may be used instead of wet etching for forming the pressure compartments Cl. In the dividing step, unnecessary parts of the pressure compartment substrate 32 and the protective substrate 35 are removed.

Next, a communication substrate bonding step is performed. In the communication substrate bonding step, the communication substrate 31, which has liquid flow passages, including the supply holes 31*a*, the communication holes 31*b*, and the relay liquid chamber 31*c*, is bonded to the pressure compartment substrate 32. The communication substrate 31 can be manufactured from a communication substrate wafer, which is, for example, a silicon wafer. The method for forming liquid flow passages in the communication substrate wafer is not specifically limited. For example, the relay liquid chamber 31*c* is formed by etching the communication substrate wafer through a first mask, and the supply holes 31*a* and the communication holes 31*b* are formed by etching the communication substrate wafer through a second mask. The etching may be wet etching or dry etching. The communication substrate 31 is bonded to the pressure compartment substrate body portion 32*a* by using, for example, an adhesive. Normal-temperature activation bonding, plasma activation bonding, etc. may be used for bonding the communication substrate 31 to the pressure compartment substrate 32.

After the step described above, a nozzle substrate bonding step, in which the nozzle substrate 41 is bonded to the −Z-directional end surface 31*f* of the communication substrate 31, is performed. The nozzle substrate 41 can be manufactured from a nozzle substrate wafer, which is, for example, a silicon wafer. The method for forming the nozzles NZ in the nozzle substrate wafer is not specifically limited. For example, the nozzles NZ are formed by etching the nozzle substrate wafer through a mask. For example, the nozzle substrate 41 is bonded to the surface 31*f* of the communication substrate 31 by using an adhesive.

A compliance substrate bonding step, in which the compliance substrate 42 is bonded to the −Z-directional end surface 31*f* of the communication substrate 31, is further performed. For example, the compliance substrate 42 is bonded to the surface 31*f* of the communication substrate 31 by using an adhesive.

A housing member bonding step, in which the housing member 36 is bonded to the +Z-directional end surface 31*h* of the communication substrate 31, is further performed. For example, the housing member 36 is bonded to the surface 31*h* of the communication substrate 31 by using an adhesive.

A wiring substrate connection step, in which the wiring substrate 51 is connected to the lead wires 52, is further performed.

The liquid ejecting head 10 including the actuator 12 illustrated in FIGS. 3, 4, and 5 is manufactured through the above steps. The manufactured liquid ejecting head 10 is used for manufacturing the liquid ejecting apparatus 100, together with the supply unit 14 for supplying the liquid LQ, the transportation unit 22 for transporting the medium MD, and the control unit 20, as illustrated in FIG. 1. Therefore, a specific example of a method for manufacturing the liquid ejecting apparatus 100 is also disclosed.

The manufacturing method described above may be modified as needed, for example, by changing the order of the steps. For example, the wiring substrate connection step may be performed before the housing member bonding step.

The piezoelectric element 34, in which the second thickness portion T2 located at the second position L2 closer to the end E1 of the second electrode 34*c* is thinner than the first thickness portion T1 located at the first position L1 in the first portion P1 of the second electrode 34*c*, is manufactured using the manufacturing method described above. Therefore, the manufacturing method according to the specific example described here makes it possible to provide an advantageous example of manufacturing the liquid ejecting head 10 and the liquid ejecting apparatus 100 for preventing a problem such as the development of a crack from occurring at the boundary between the overlapping portion OL and the non-overlapping portion NOL in the piezoelectric layer 34*b*.

Figure 17:
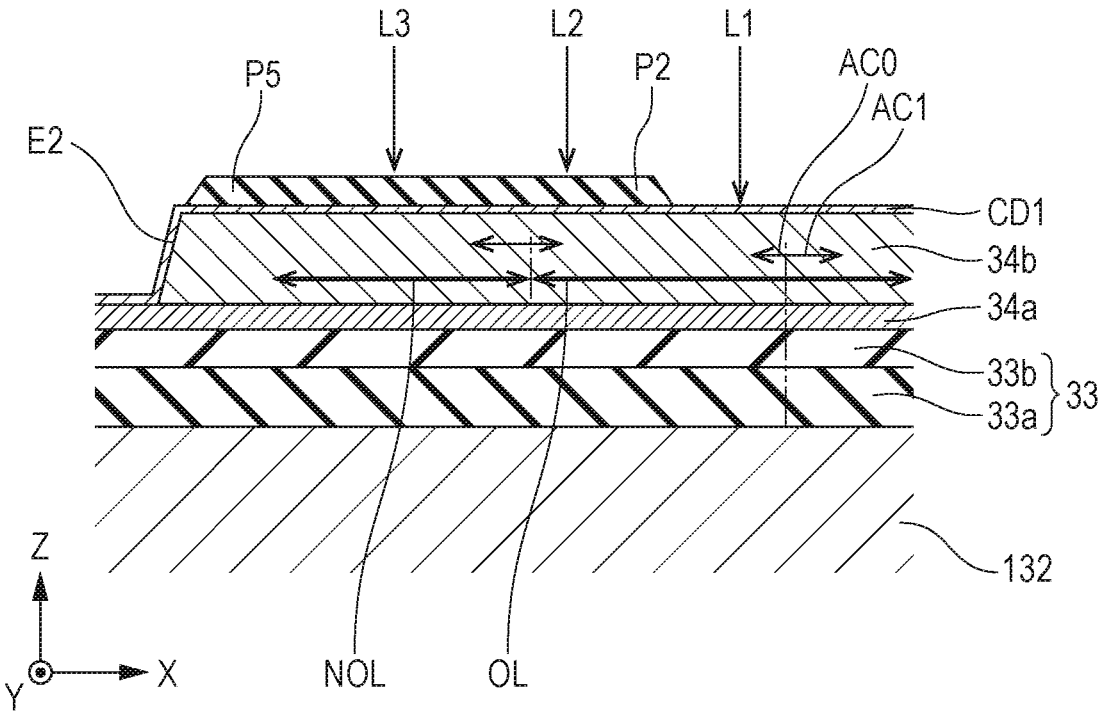
FIG. 17 is a sectional view that schematically illustrates an example of forming the second portion and the fifth portion.

As illustrated in FIGS. 17 to 20, the third electrode 37 that includes the fifth portion P5 that is less conductive may be formed together with the second electrode 34*c*. The diaphragm forming step illustrated in FIG. 9, the layering step illustrated in FIGS. 10 and 11, and the first conductive portion forming step illustrated in FIG. 12 are performed also in this case. After these steps, as illustrated in FIG. 17, the second portion forming step, in which the second portion P2 that is continuous to the fifth portion P5 that will become a part of the third electrode 37 is formed, and the second portion P2 is not formed at the first position L1, is performed. The second portion P2 that is continuous to the fifth portion P5 is less conductive than the first conductive portion CD1 and is next to the first conductive portion CD1 in the +Z direction at the second position L2 and the third position L3. Of course, the fifth portion P5 that is continuous from the second portion P2 can be formed using the method of forming the second portion P2 before patterning as described above. That is, similarly to the second portion P2, the fifth portion P5 whose principal component is $TiO_x$, $TaO_x$, $AlO_x$, $ZrO_x$, or $SiO_x$, etc. is formed using a physical vapor growth method, depositing a film of metal by the physical vapor growth method, thermal oxidation of the metal film, etc. Lithography, etc. can be used for the patterning.

The second portion P2 for preventing a crack from being developed in the piezoelectric layer 34*b*, and the fifth portion P5 for preventing migration from occurring, are not formed directly on the piezoelectric layer 34*b* but formed on the first conductive portion CD1, thereby being distanced from the piezoelectric layer 34*b* in the +Z direction. Therefore, degradation that might occur if a protective film were formed directly on the piezoelectric layer 34*b* is prevented.

Figure 18:
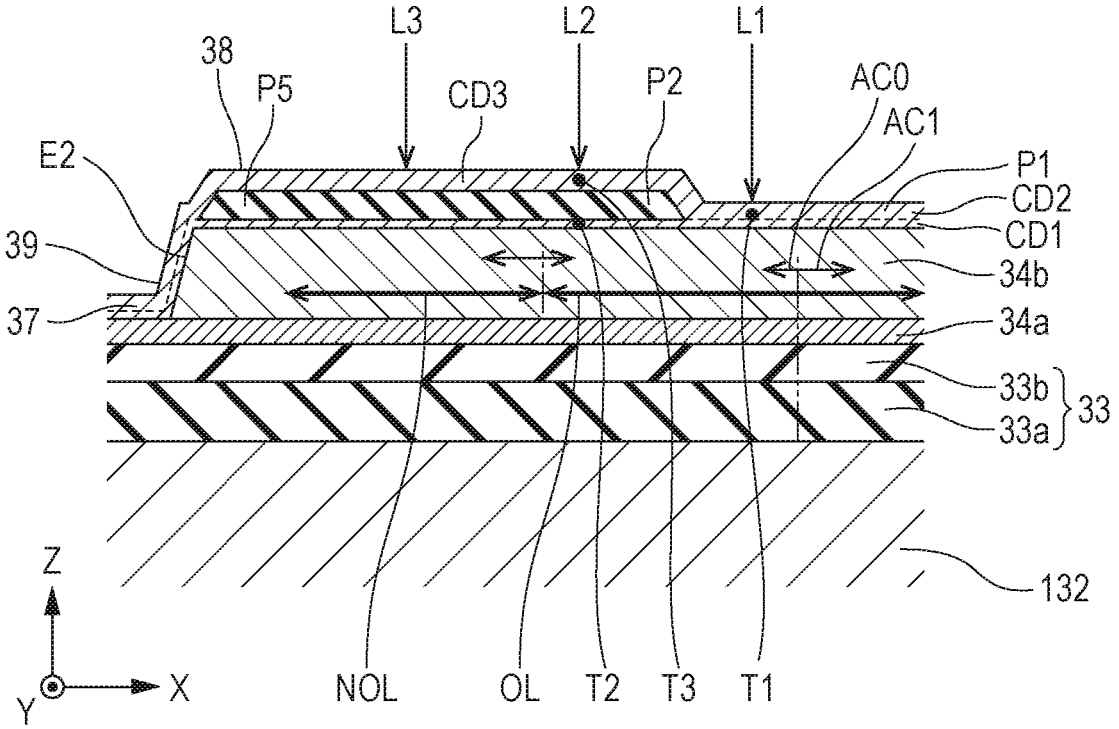
FIG. 18 is a sectional view that schematically illustrates an example of forming the second conductive portion and the third conductive portion.
Figure 19:
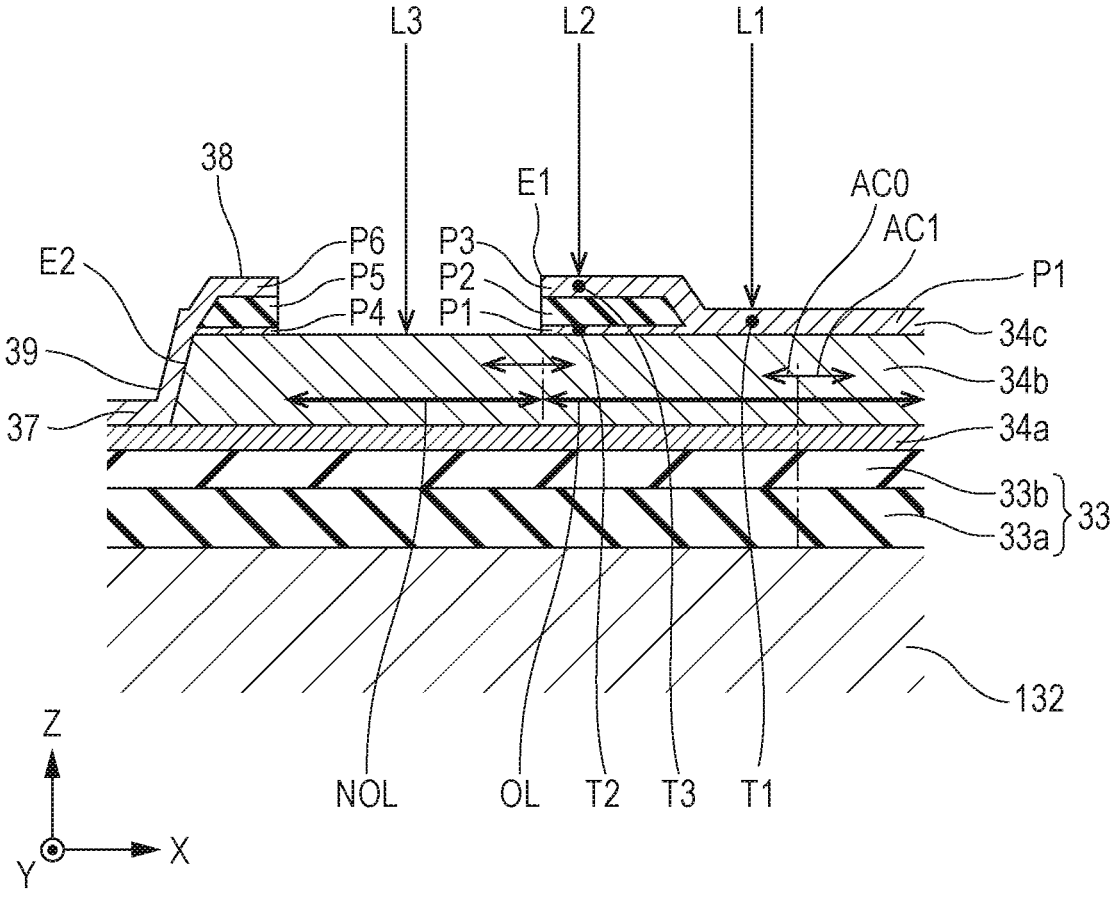
FIG. 19 is a sectional view that schematically illustrates an example of forming the second electrode and the third electrode.
Figure 20:
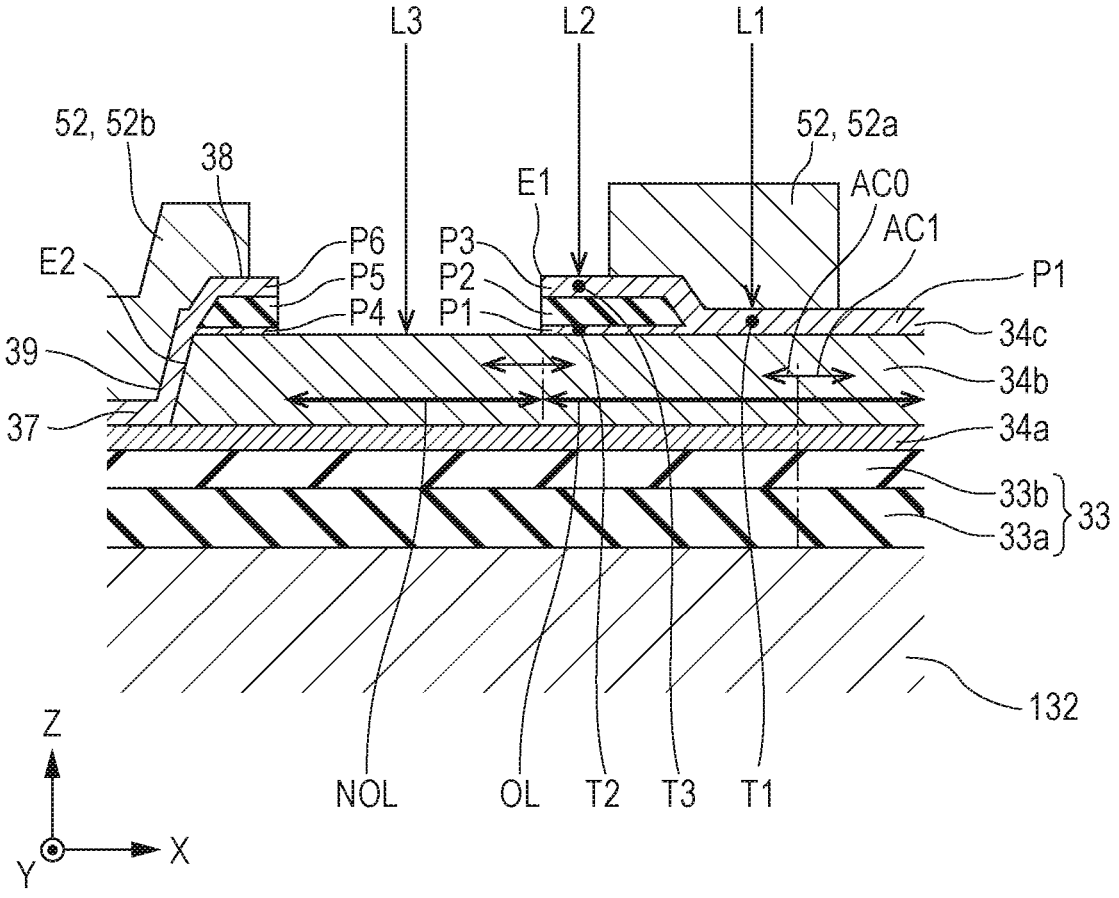
FIG. 20 is a sectional view that schematically illustrates an example of forming lead wires.

Next, as illustrated in FIGS. 18 and 19, the second conductive portion forming step of forming the second conductive portion CD2 is performed. The second conductive portion forming step includes a second conductive portion layering step, in which a layer of the second conductive portion CD2 is formed, a third conductive portion layering step, in which a layer of the third conductive portion CD3 is formed, and a patterning step.

FIG. 18 schematically illustrates an example of forming the third conductive portion CD3 on the second portion P2 and the fifth portion P5 continuously in the third conductive portion layering step and forming the second conductive portion CD2 on a part of the first conductive portion CD1 in the second conductive portion layering step, wherein this part is the part on which the continuous layer of the second portion P2 and the fifth portion P5 has not been formed. The thickness of the second conductive portion CD2 and the thickness of the third conductive portion CD3 are configured to be the same as the thickness t3 of the third thickness portion T3 in the third portion P3 of the second electrode 34*c* as illustrated in FIG. 8. It is possible to form the second conductive portion CD2 and the third conductive portion CD3 by depositing a film of metal such as iridium or aluminum, etc. A physical vapor growth method, etc. can be used for depositing the film of metal.

FIG. 19 schematically illustrates an example of forming the second electrode 34*c* and the third electrode 37 from the conductive portions CD1, CD2, and CD3 in the patterning step. Lithography, etc. can be used for the patterning. In the patterning step, the conductive portions CD1, CD2, and CD3 are removed from the pressure compartment non-corresponding area AC0 including the third position L3. As a result of this patterning, the first thickness portion T1 of the second electrode 34*c* is formed on the piezoelectric layer 34*b* at the first position L1. At the second position L2, the second thickness portion T2 of the second electrode 34*c* is formed on the piezoelectric layer 34*b*, the second portion P2 of the second electrode 34*c* is formed on the second thickness portion T2, and the third portion P3 of the second electrode 34*c* is formed on the second portion P2. Neither the second electrode 34*c* nor the third electrode 37 exists at the third position L3. The continuing portion 38 of the third electrode 37 includes the fourth portion P4 that is formed on the piezoelectric layer 34*b*, the fifth portion P5 that is less conductive than the fourth portion P4, and the sixth portion P6 that is more conductive than the fifth portion P5, in this order in the +Z direction.

Since the continuing portion 38 of the third electrode 37 has the fifth portion P5, which is less conductive, electric field intensity between the second electrode 34*c* and the third electrode 37 decreases, and migration, a phenomenon of an electric current flow between the second electrode 34*c* and the third electrode 37, is prevented effectively.

Next, the lead wire forming step, which includes the lead wire stacking step and the patterning step, is performed. It is possible to form the lead wires 52 by, for example, depositing a film of metal such as gold. A physical vapor growth method, etc. can be used for depositing the film of metal. Lithography, etc. can be used for the patterning. By going through the lead wire forming step, the lead wire 52*a* is stacked on a part of the second electrode 34*c*, and the lead wire 52*b* is stacked on a part of the third electrode 37 such that the distance between the fifth portion P5 and the second electrode 34*c* is shorter than the distance between the lead wire 52*b* and the second electrode 34*c* in the X-axis direction. This prevents the migration described earlier effectively.

After the above step, the protective substrate bonding step of bonding the protective substrate 35 illustrated in FIG. 3 to the insulating layer 33*b*, the pressure compartment substrate forming step, the communication substrate bonding step, the nozzle substrate bonding step, the compliance substrate bonding step, the housing member bonding step, and the wiring substrate connection step are performed as described above.

The liquid ejecting head 10 including the actuator 12 illustrated in FIG. 7 is manufactured through the above steps. The manufactured liquid ejecting head 10 is used for manufacturing the liquid ejecting apparatus 100, together with the supply unit 14 for supplying the liquid LQ, the transportation unit 22 for transporting the medium MD, and the control unit 20, as illustrated in FIG. 1.

The specific example illustrated in FIGS. 17 to 20 also makes it possible to provide an advantageous example of manufacturing the liquid ejecting head 10 and the liquid ejecting apparatus 100 for preventing a problem such as the development of a crack from occurring at the boundary between the overlapping portion OL and the non-overlapping portion NOL in the piezoelectric layer 34*b*. Moreover, migration, a phenomenon of an electric current flow between the second electrode 34*c* and the third electrode 37, is prevented.

5. VARIATION EXAMPLES

A printer as an example of a liquid ejecting apparatus includes, for example, a copier, a facsimile, a multi-function peripheral, and the like, besides a print-only machine. Of course, the liquid ejecting apparatus is not limited to a printer.

Liquid ejected from a fluid ejecting head encompasses, but is not limited to, fluid such as a solution in which a solute such as dye is dissolved in a solvent, a sol in which solid particles such as pigments or metal particles are dissolved in a dispersion medium, and the like. Such liquid encompasses, but is not limited to, a solution of ink, liquid crystal, a conductive material, a living organism, and the like. The liquid ejecting apparatus includes, for example, an apparatus for manufacturing a color filter for a liquid crystal display, etc., an apparatus for manufacturing electrodes for an organic EL display, etc., a biochip manufacturing apparatus, a manufacturing apparatus for forming the wiring of a wiring substrate, etc. The organic EL mentioned here is an abbreviation for organic electroluminescence.

In the specific example described above, the second electrode 34*c* is a common electrode that is common to the plurality of nozzles NZ. However, the disclosed technique may be applied to a configuration in which the second electrode is an individual electrode. If the second electrode is an individual electrode, the first electrode may be a common electrode that is common to the plurality of nozzles NZ, and/or the piezoelectric layer may be common to the plurality of nozzles NZ.

The actuator 12 disclosed in the specific example described above may be applied to devices such as, for example, an ultrasonic wave oscillator, an ultrasonic motor, a piezoelectric transformer, a piezoelectric speaker, a piezoelectric pump, a pressure-electricity converter, and the like.

6. CONCLUSION

As explained above, the present disclosure with various embodiments makes it possible to provide a technique of an actuator, a liquid ejecting head, a liquid ejecting apparatus, etc. that prevents a problem such as the development of a crack from occurring at the boundary between an overlapping portion and a non-overlapping portion in a piezoelectric layer. Of course, basic operations and basic effects described above can be obtained also from a technique that is made up of only elements of an independent claim.

The present disclosure may be implemented in a configuration obtained by replacing any of components disclosed in the foregoing examples with each other or one another or changing a combination thereof, in a configuration obtained by replacing any of components disclosed in the foregoing examples and known art with each other or one another or changing a combination thereof, and the like. These configurations, etc. are also within the scope of the present disclosure.

What is claimed is:

1. A liquid ejecting head that ejects liquid, comprising:
a diaphragm;
a first electrode;
a piezoelectric layer; and
a second electrode, wherein
the diaphragm, the first electrode, the piezoelectric layer, and the second electrode are comprised in this order in a first direction,
the second electrode includes a first portion that is next to the piezoelectric layer in the first direction and is electrically conductive,
a length in the first direction is defined as a thickness,
one position in a second direction intersecting with the first direction is defined as a first position,
another one position is defined as a second position that is closer to an end of the second electrode in the second direction than the first position is, and
when above definition is given, the thickness of the first portion at the second position is less than the thickness of the first portion at the first position.

2. The liquid ejecting head according to claim 1, wherein
the second electrode further includes a second portion that is next to the first portion in the first direction and is less conductive than the first portion, and
the second portion exists at the second position and does not exist at the first position.

3. The liquid ejecting head according to claim 2, wherein
the second portion is insulator.

4. The liquid ejecting head according to claim 2, wherein
a Young's modulus of the second portion is greater than a Young's modulus of the first portion.

5. The liquid ejecting head according to claim 2, wherein
the second portion has a compressive stress.

6. The liquid ejecting head according to claim 2, wherein
a principal component of the first portion is iridium, and
a principal component of the second portion is titanium oxide, tantalum oxide, aluminum oxide, zirconium oxide, or silicon oxide.

7. The liquid ejecting head according to claim 2, wherein
the second electrode further includes a third portion that is next to the second portion in the first direction and is more conductive than the second portion, and
the third portion exists at the second position and does not exist at the first position.

8. The liquid ejecting head according to claim 7, wherein
a principal component of the first portion is identical to a principal component of the third portion.

9. The liquid ejecting head according to claim 7, wherein,
at the first position, the second electrode is composed only of the first portion.

10. The liquid ejecting head according to claim 7, wherein,
at the second position, the second electrode includes the first portion, the second portion formed on the first portion, and the third portion formed on the second portion in this order in the first direction.

11. The liquid ejecting head according to claim 7, wherein the thickness of the first portion at the second position is less than the thickness of the third portion at the second position.

12. The liquid ejecting head according to claim 7, wherein a sum of the thickness of the first portion at the second position and the thickness of the third portion at the second position is equal to the thickness of the first portion at the first position.

13. The liquid ejecting head according to claim 1, wherein at a third position that is closer to an end of the piezoelectric layer in the second direction than the first position and the second position are, the piezoelectric layer exists, and the second electrode does not exist.

14. The liquid ejecting head according to claim 13, wherein when a predetermined voltage is applied between the first electrode and the second electrode, an amount of distortion of the piezoelectric layer at the second position is smaller than an amount of distortion of the piezoelectric layer at the first position and is larger than an amount of distortion of the piezoelectric layer at the third position.

15. The liquid ejecting head according to claim 1, further comprising:

a third electrode that includes a continuing portion, which is next to the piezoelectric layer in the first direction, and a covering portion, by which an end of the piezoelectric layer is covered; wherein the second electrode and the third electrode are at a distance from each other in the second direction.

16. The liquid ejecting head according to claim 14, wherein the continuing portion includes a fourth portion that is next to the piezoelectric layer in the first direction and is electrically conductive.

17. The liquid ejecting head according to claim 16, wherein the continuing portion further includes a fifth portion that is next to the fourth portion in the first direction and is less conductive than the fourth portion.

18. The liquid ejecting head according to claim 17, wherein the continuing portion further includes a sixth portion that is next to the fifth portion in the first direction and is more conductive than the fifth portion.

19. A liquid ejecting apparatus, comprising:

the liquid ejecting head according to claim 1; and a control unit that controls operation of ejecting the liquid from the liquid ejecting head according to claim 1.

20. An actuator, comprising:

a diaphragm;

a first electrode;

a piezoelectric layer; and a second electrode, wherein the diaphragm, the first electrode, the piezoelectric layer, and the second electrode are comprised in this order in a first direction, the second electrode includes a first portion that is next to the piezoelectric layer in the first direction and is electrically conductive, a length in the first direction is defined as a thickness, one position in a second direction intersecting with the first direction is defined as a first position, another one position is defined as a second position that is closer to an end of the second electrode in the second direction than the first position is, and when above definition is given, the thickness of the first portion at the second position is less than the thickness of the first portion at the first position.

21. A method for manufacturing a liquid ejecting head that includes a diaphragm, a first electrode, a piezoelectric layer, and a second electrode in this order in a first direction, wherein the second electrode includes a first portion that is next to the piezoelectric layer in the first direction and is electrically conductive, a plurality of positions in a second direction intersecting with the first direction includes a first position and a second position, the second position being closer to an end of the second electrode than the first position is, and the first portion includes a first conductive portion and a second conductive portion, the method comprising:

a layering step of forming the first electrode and the piezoelectric layer in layers in this order over the diaphragm;

a first conductive portion forming step of forming the first conductive portion that is next to the piezoelectric layer in the first direction; and a second conductive portion forming step of forming, at the first position, the second conductive portion that is next to the first conductive portion in the first direction, and not forming the second conductive portion at the second position.

22. The method according to claim 21, further comprising:

a second portion forming step; wherein the second electrode further includes a second portion that is less conductive than the first portion, and in the second portion forming step, the second portion that is next to the first conductive portion in the first direction is formed at the second position, and the second portion is not formed at the first position.

* * * * *